US007409901B2

(12) United States Patent
Lucas et al.

(10) Patent No.: US 7,409,901 B2
(45) Date of Patent: Aug. 12, 2008

(54) VARIABLE STROKE ASSEMBLY

(75) Inventors: Bruce C. Lucas, Marlow, OK (US); Stanley V. Stephenson, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 630 days.

(21) Appl. No.: 10/974,577

(22) Filed: Oct. 27, 2004

(65) Prior Publication Data

US 2006/0088425 A1 Apr. 27, 2006

(51) Int. Cl.
*F04B 49/12* (2006.01)
*F02B 75/04* (2006.01)

(52) U.S. Cl. ..... 92/13.1; 92/13; 92/13.7

(58) Field of Classification Search ..... 92/13, 92/13.1, 13.7, 60.5
See application file for complete search history.

(56) References Cited

U.S. PATENT DOCUMENTS

| | | | | | |
|---|---|---|---|---|---|
| 635,258 | A | * | 10/1899 | Lange | 417/218 |
| 2,792,156 | A | * | 5/1957 | Camp | 92/13.7 |
| 2,873,611 | A | * | 2/1959 | Biermann | 92/60.5 |
| 3,738,230 | A | | 6/1973 | Censi | 92/13.3 |
| 3,834,839 | A | | 9/1974 | Krebs et al. | 417/505 |
| 4,028,018 | A | | 6/1977 | Audsley | 417/534 |
| 4,131,094 | A | * | 12/1978 | Crise | 123/48 B |
| 4,240,386 | A | * | 12/1980 | Crist | 92/60.5 |
| 4,264,281 | A | * | 4/1981 | Hammelmann | 92/13.1 |
| 4,346,677 | A | * | 8/1982 | Nye | 123/53.1 |
| 4,682,532 | A | | 7/1987 | Erlandson | 92/13.7 |
| 4,830,589 | A | | 5/1989 | Pareja | 417/539 |
| 5,136,987 | A | * | 8/1992 | Schechter et al. | 123/48 B |
| 5,335,632 | A | * | 8/1994 | Hefley | 123/48 B |
| 6,397,794 | B1 | | 6/2002 | Sanderson et al. | 123/48 |
| 6,446,587 | B1 | | 9/2002 | Sanderson et al. | 123/56.1 |
| 6,742,441 | B1 | | 6/2004 | Surjaatmadja et al. | 92/13.7 |
| 2004/0265155 | A1 | | 12/2004 | Hunter | |
| 2006/0088423 | A1 | | 4/2006 | Brunet et al. | |

OTHER PUBLICATIONS

US 6,019,073, 02/2000, Sanderson (withdrawn)

* cited by examiner

*Primary Examiner*—Thomas E Lazo
(74) *Attorney, Agent, or Firm*—John W. Wustenberg; Conley Rose, P.C.

(57) ABSTRACT

A variable stroke assembly enables the piston stroke length of a positive displacement pump to be varied while maintaining a substantially constant unswept volume in the piston cylinder. Alternatively, a variable stroke assembly enables the piston stroke length of a pump or an engine to be varied while maintaining a substantially constant compression ratio. In an embodiment, the variable stroke assembly comprises an automated system that varies the stroke length of the pump or engine piston via an actuator that may be actuated remotely. The automated system may further comprise a linkage assembly that is positioned by the actuator. In an embodiment, the linkage assembly comprises a crankshaft throw, a connecting rod connected to the crankshaft throw, a variable stroke component connected to the connecting rod, and a slider that traverses the variable stroke component to vary the stroke length of the piston.

35 Claims, 16 Drawing Sheets

VARIABLE STROKE ASSEMBLY

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention relates to a variable stroke assembly for adjusting the stroke length of a pump piston or an engine piston to achieve a desired result. More particularly, the present invention relates to a variable stroke assembly for adjusting the stroke length of a pump piston to maintain a substantially constant, unswept volume in the piston cylinder, or for adjusting the stroke length of a pump piston or an engine piston to maintain a substantially constant compression ratio.

BACKGROUND OF THE INVENTION

Variable stroke piston-type and plunger-type positive displacement pumps are well known and have long been used in a variety of industries. A typical positive displacement pump will include at least one piston or plunger arranged to move in reciprocating fashion within a piston cylinder by means of a conventional crankshaft and connecting rod assembly. In a piston pump, the piston rod has a smaller diameter than the piston head, whereas in a plunger pump, the piston rod has the same diameter as the piston head. For illustrative purposes, the discussions herein are directed to piston pumps, although the principles apply to plunger pumps as well.

In operation, upon each suction stroke of the pump piston, a predetermined quantity of fluid is drawn into the piston cylinder depending upon the stroke length of the piston. During the pressure stroke of the piston, the fluid is discharged from the piston cylinder at a desired pressure. Regardless of the selected stroke length of the piston, a certain dead volume of fluid, known as the "unswept volume," will remain within the piston cylinder because the piston does not completely evacuate the cylinder, even at the maximum stroke length of the piston. In most variable stroke pumping systems, the minimum unswept volume corresponds to the maximum stroke length of the piston, and the unswept volume increases as the stroke length of the piston decreases. When pumping compressible fluids or when pumping incompressible fluids at high pressures, the greater the unswept volume, the lower the efficiency of the pump due to compression of the fluid in the unswept volume area as well as expansion of the piston cylinder due to pressure. If the unswept volume becomes large enough and the pressure high enough, then all of the fluid just compresses and decompresses within the cylinder without actually leaving the pump. Therefore, a need exists for a variable stroke assembly capable of adjusting the stroke length of a pump piston while maintaining a substantially constant, and preferably minimized, unswept volume.

Variable stroke engine systems are also well known. A typical engine includes at least one piston arranged to move in reciprocating fashion within a piston cylinder, similar to a pump. However, the operation of an engine is opposite from the operation of a pump. In particular, for a 4-cycle engine, for example, the engine piston is extended during the exhaust cycle to a predetermined location within the piston cylinder, depending upon the selected stroke length of the piston. The engine piston is then retracted during the intake cycle while an air-fuel mixture is drawn into the piston cylinder through an inlet valve. The engine piston is extended again during the compression cycle to compress the air-fuel mixture. A spark plug is commonly used to ignite the fuel during the compression cycle, which increases the temperature and pressure within the cylinder. This heat and pressure act against the engine piston and cause it to retract during the power cycle at a given force, which is exerted on other engine components. Therefore, in contrast to a pump piston, which is retracted and extended by a force to draw fluid into the piston cylinder and then discharge the fluid at a higher pressure, an engine piston exerts a force during the power cycle to drive one or more engine components.

Regardless of the selected stroke length of the engine piston, a certain dead volume of fluid, i.e. the "unswept volume", will always be present in the piston cylinder because the engine piston does not extend to the very end of the piston cylinder, even at its maximum stroke length. For proper engine operation, it is desirable to maintain a substantially constant compression ratio regardless of the stroke length of the piston. The compression ratio is the ratio of the total volume in the piston cylinder to the unswept volume in the piston cylinder. Therefore, a need exists for a variable stroke assembly capable of adjusting the stroke length of an engine piston while maintaining a substantially constant compression ratio.

The flow rate of a pump, or the power output of an engine, is a function of the speed at which the piston is driven, and the stroke length of the piston. Thus, to vary the flow rate of a pump, the speed of the motor that drives the pump may be varied, such as, for example, via a gear box, transmission, or variable speed drive. To vary the power output of an engine, the drive speed of the piston during the compression cycle may be varied. Alternatively, to vary the flow rate of a pump or the power output of an engine for a given drive speed, the piston stroke length may be adjusted by adjusting the distance that the piston is retracted and extended within the cylinder. Conventionally, the piston stroke length is adjusted manually via various mechanical means, such as, for example, by adjusting the throw of an eccentric lobe that rotates to drive the piston, or by adjusting swivels, cams, or linkages. Therefore, a need exists for an actuatable variable stroke assembly that enables adjustments to the stroke length of a pump piston or an engine piston, and which may also be automated for onsite or remote operation.

SUMMARY OF THE INVENTION

In one aspect, the present invention relates to a variable stroke assembly comprising an actuatable system operatively connected to a piston for varying the piston stroke length. In an embodiment, the piston reciprocates within a piston cylinder of a positive displacement pump, and a substantially constant unswept volume is maintained within the cylinder as the stroke length of the piston is varied. In another embodiment, the piston reciprocates within a piston cylinder of an engine or pump, and a substantially constant compression ratio is maintained as the stroke length of the piston is varied. In one embodiment, the actuatable system is automated and may be actuated remotely. In another embodiment, the actuatable system comprises an actuator, and the actuatable system may further comprise a linkage assembly connected to the piston that is positioned via the actuator to vary the stroke length of the piston. The linkage assembly may comprise a crankshaft, a connecting rod, a variable stroke component, and a slider coupled to the piston that traverses the variable stroke component to vary the stroke length of the piston. The variable stroke component may comprise an arc or a linear member.

In another aspect, the present invention relates to a pumping system comprising a positive displacement pump having a piston with a variable stroke length, and an actuatable linkage assembly for varying the stroke length of the piston, wherein the pump maintains a substantially constant unswept volume as the stroke length of the piston is varied.

In yet another aspect, the present invention relates to an engine or pump system comprising an engine or pump having a piston with a variable stroke length, and an actuatable linkage assembly for varying the stroke length of the piston, wherein the engine or pump maintains a substantially constant compression ratio as the stroke length of the piston is varied.

In still another aspect, the present invention relates to a method for pumping a fluid comprising varying the stroke length of a piston in a positive displacement pump while maintaining a substantially constant unswept volume within the pump. In various embodiments, the stroke length of the pump piston is varied by an actuatable system, by moving a slider that connects to the pump piston, by actuating a slider that connects to the pump piston, or by actuating a linkage assembly component to move a slider that connects to the pump piston. In an embodiment, the substantially constant unswept volume is measured at the maximum stroke length of the piston. In another embodiment, the method further comprises completing a pressure stroke of the piston at a fully extended position of the piston regardless of the piston stroke length.

In yet another aspect, the present invention relates to a method for operating an engine or pump comprising varying the stroke length of a piston in the engine or pump while maintaining a substantially constant compression ratio. In various embodiments, the stroke length of the engine or pump piston is varied by an actuatable system, by moving a slider that connects to the engine or pump piston, or by actuating a slider that connects to the engine or pump piston.

DETAILED DESCRIPTION

Figure 1:
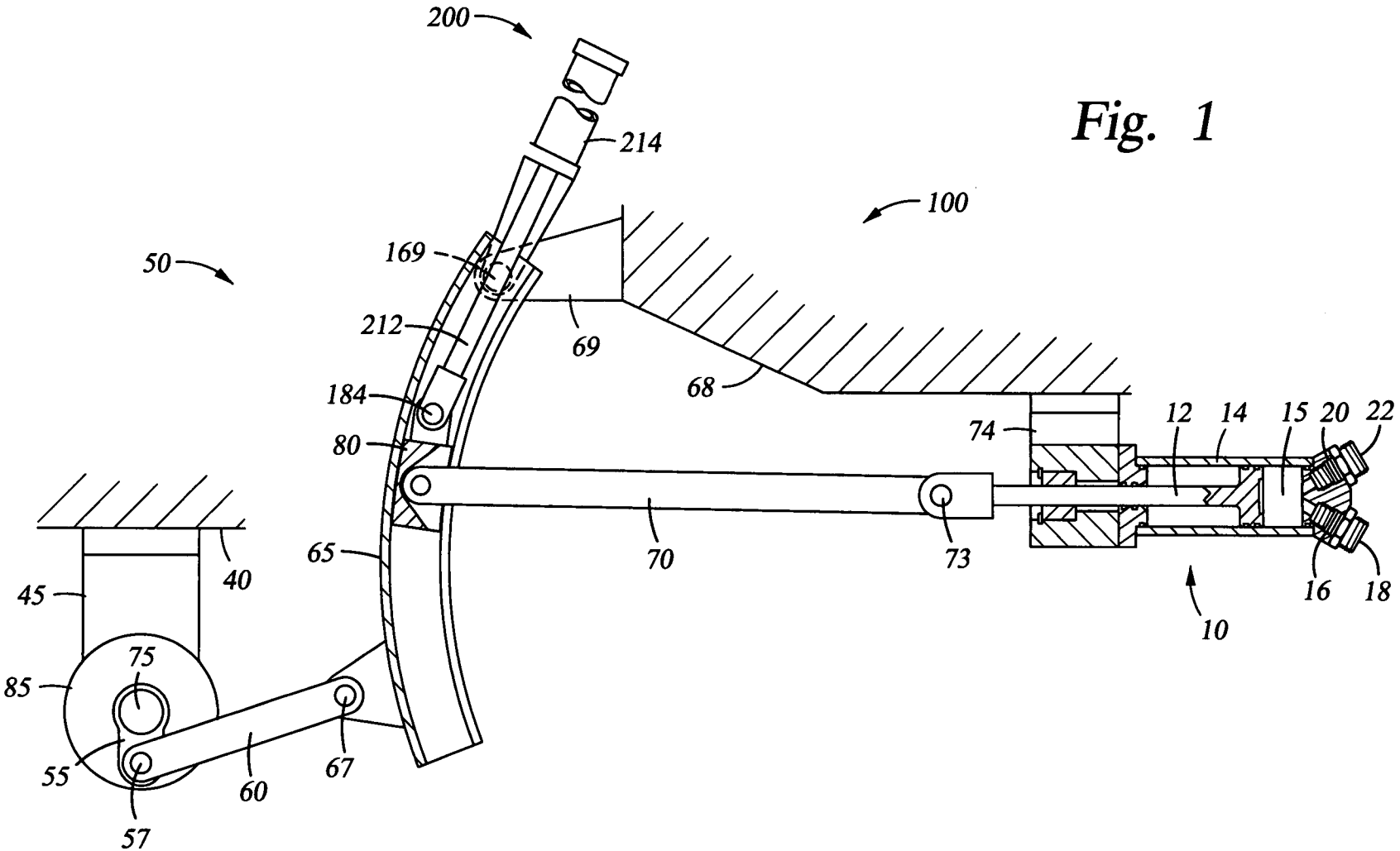
FIG. 1 is a cross-sectional side view of one embodiment of a variable stroke assembly for varying the stroke length of a piston within a single positive displacement pump connected to a pump motor.

FIG. 1 is a cross-sectional side view of one embodiment of a variable stroke assembly, generally designated as 100, comprising a linkage assembly 50 for varying the piston stroke length of an exemplary positive displacement pump 10. A bracket 74 fixes the pump 10 to a fixed support 68. The pump 10 comprises a piston 12 disposed within a cylinder 14 having a check valve 16 mounted within an inlet port 18 and a non-return valve 20 mounted within an outlet port 22. The piston 12 is reciprocated back and forth within the cylinder 14 to operate the pump 10. For ease of illustration and discussion, only one cylinder 14 has been depicted. However, the pump 10 may comprise multiple cylinders 14. Further, as one of ordinary skill in the art will readily appreciate, the variable stroke assembly 100 is depicted and described in connection with a positive displacement piston pump 10 for illustrative purposes only, and may equally be used to vary the stroke length of an engine piston, for example.

Figure 2A:
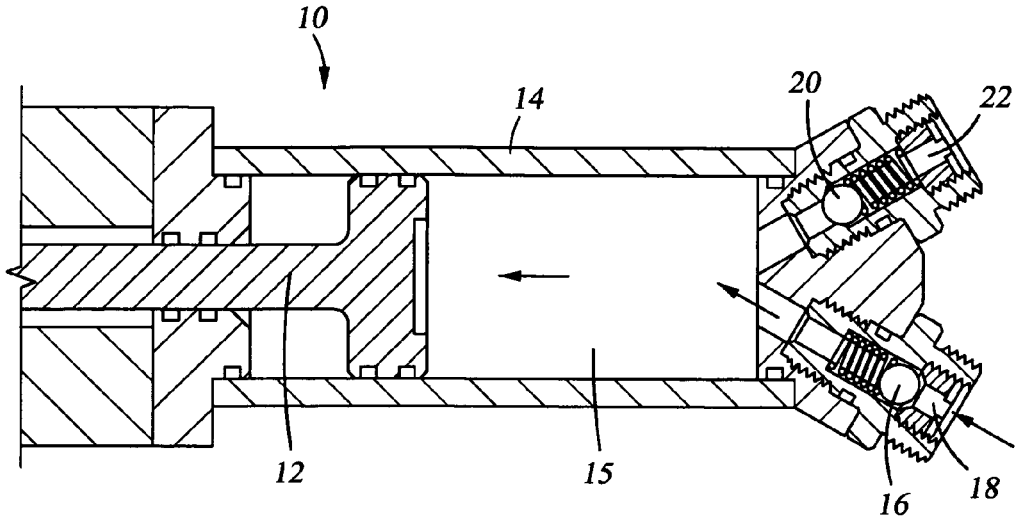
FIG. 2A is an enlarged, cross-sectional side view showing the operation of the pump of FIG. 1 on the suction stroke of the piston.
Figure 2B:
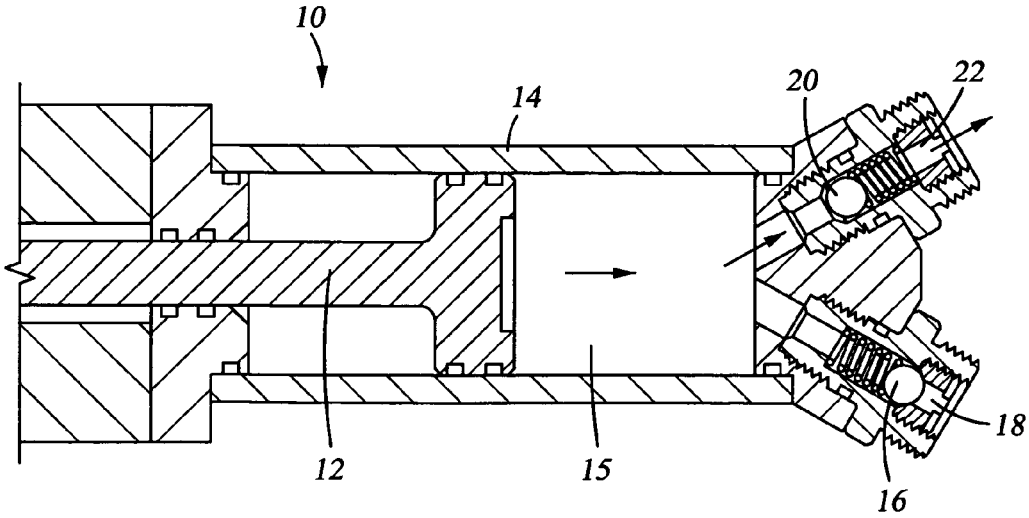
FIG. 2B is an enlarged, cross-sectional side view showing the operation of the pump of FIG. 1 on the pressure stroke of the piston.

Referring now to FIGS. 2A and 2B, enlarged, cross-sectional side views are depicted of the pump 10 in operation when the piston 12 is on the suction stroke and when the piston 12 is on the pressure stroke, respectively. As shown in FIG. 2A, when the piston 12 is retracted on the suction stroke, fluid is drawn into the cylinder 14 through the check valve 16 in the inlet port 18, as represented by the flow arrows, to fill a chamber 15 within the piston cylinder 14, and the non-return valve 20 prevents the fluid from flowing in through the outlet port 22. Conversely, as depicted in FIG. 2B, when the piston 12 is extended on the pressure stroke, fluid is discharged from the chamber 15 through the non-return valve 20 in the outlet port 22, as represented by the flow arrows, and the check valve 16 in the inlet port 18 prevents fluid from flowing out through the inlet port 18.

If FIGS. 2A and 2B depicted the operation of an engine instead of pump 10, then when the piston 12 is retracted on the suction stroke (intake cycle) as shown in FIG. 2A, an air-fuel mixture would be drawn into the cylinder 14 through the check valve 16 in the inlet port 18, as represented by the flow arrows, to fill the chamber 15 within the piston cylinder 14, and the non-return valve 20 would prevent the fluid from flowing in through the outlet port 22. Then, unlike the operation depicted FIG. 2B, when the piston 12 is extended on the compression cycle, instead of discharging fluid from the chamber 15 through the non-return valve 20, both the check valve 16 and the non-return valve 20 would be closed, and the air-fuel mixture would be compressed within the chamber 15. A spark plug (not shown) would ignite the air-fuel mixture during the compression cycle, thereby increasing the temperature and pressure within the cylinder 14. This heat and pressure would act against the engine piston 12 and cause it to retract in the cylinder 14 during the power cycle at a given force that would be exerted on other engine components.

Referring again to FIG. 1, the linkage assembly 50 comprises a crankshaft throw 55, a connecting rod 60, a variable stroke arc 65 having a convexly curved shape with respect to the pump piston 12, a cylinder rod 70, and a slider 80. The crankshaft throw 55 connects at one end to a motor 85 having a rotating motor shaft 75, depicted in end view in FIG. 1. The motor 85 is mounted via a bracket 45 to a fixed support 40. The opposing end of the crankshaft throw 55 connects via a pivotal connection 57 to the connecting rod 60. The variable stroke arc 65 connects at one end to the connecting rod 60 via a pivotal connection 67, and at an opposing end via a pivotal connection 169 to a bracket 69 attached to the fixed support 68. The cylinder rod 70 connects at one end to the slider 80, and at an opposing end to the pump piston 12 via a pivotal connection 73.

The variable stroke assembly 100 may further include an actuator 200, depicted as a hydraulic cylinder comprising a piston 212 disposed within a chamber 214. Alternately, the actuator 200 may comprise an electric jack, a rack and pinion assembly, a screw drive, a gear drive, or any other transactional actuator familiar to those of ordinary skill in the art. As shown in FIG. 1, the actuator 200 connects at one end to the bracket 69 via pivotal connection 169 and connects at the opposing end to the slider 80 via a pivotal pin 184. The slider 80 is designed to traverse the variable stroke arc 65, and the slider 80 is moved and held in position by the actuator 200.

Figure 3:
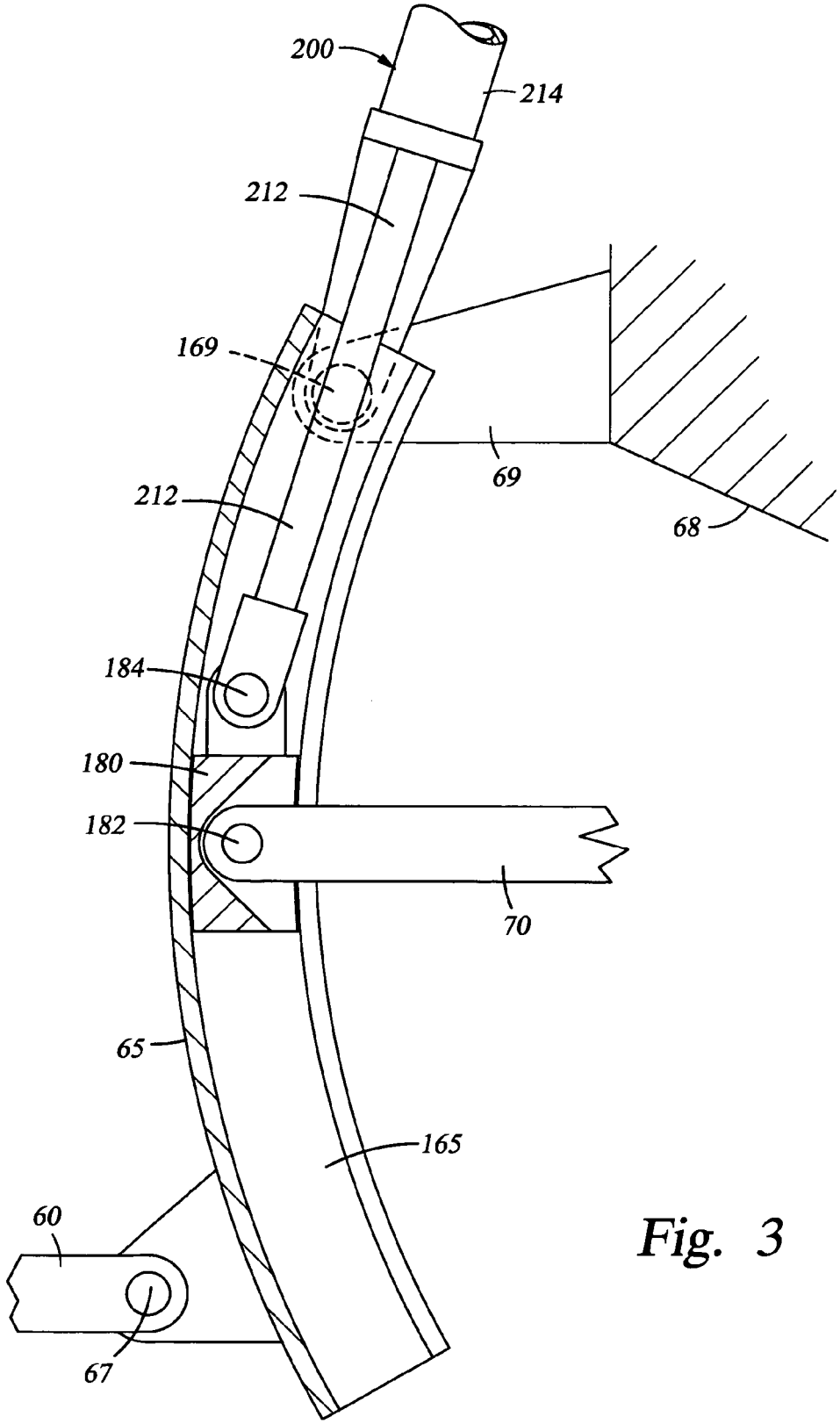
FIG. 3 is an enlarged, cross-sectional side view of one embodiment of a slider comprising an internal slider block operatively connected to an actuator.
Figure 4:
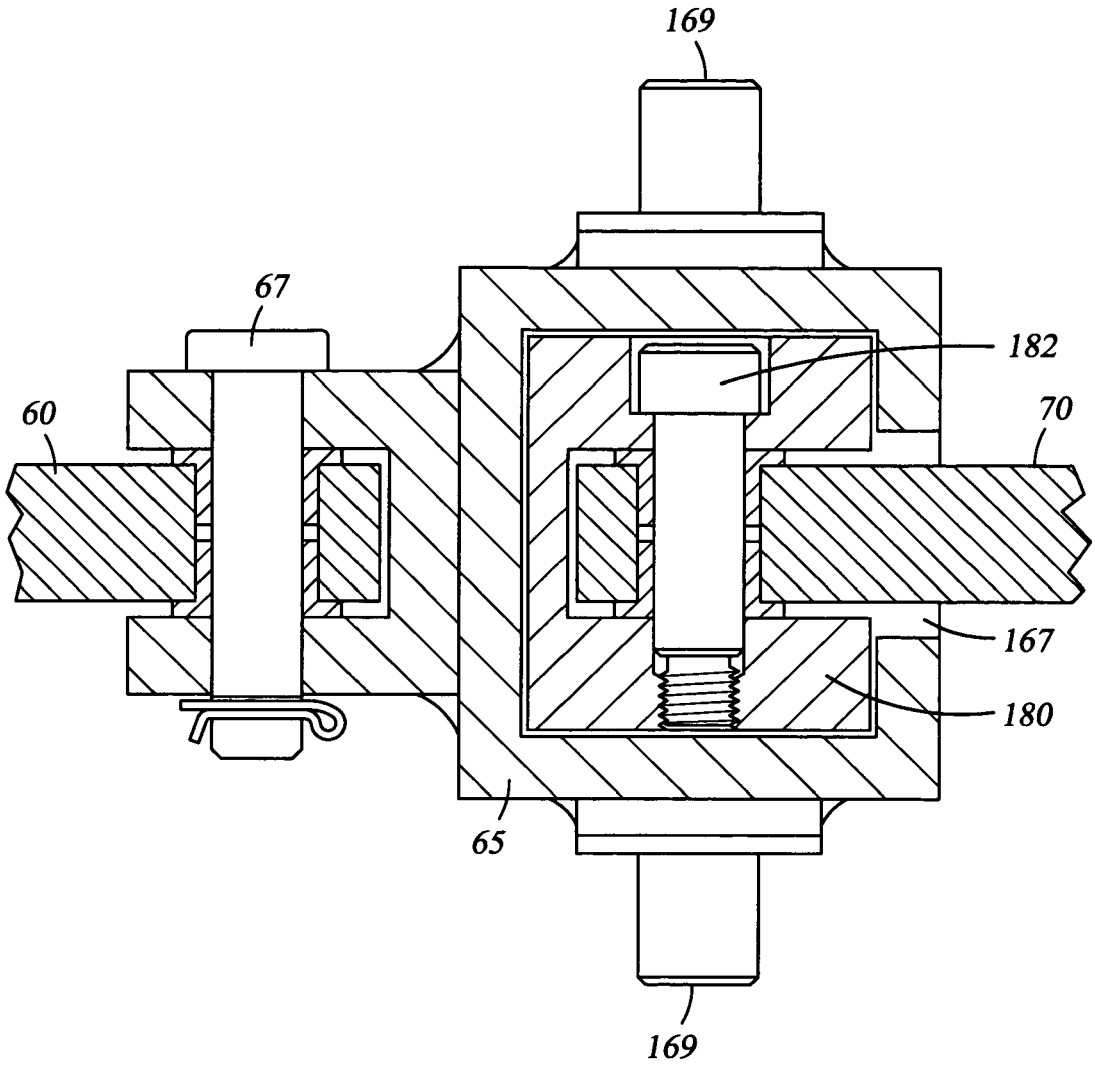
FIG. 4 is an enlarged, cross-sectional top view of the internal slider block of FIG. 3.
Figure 5:
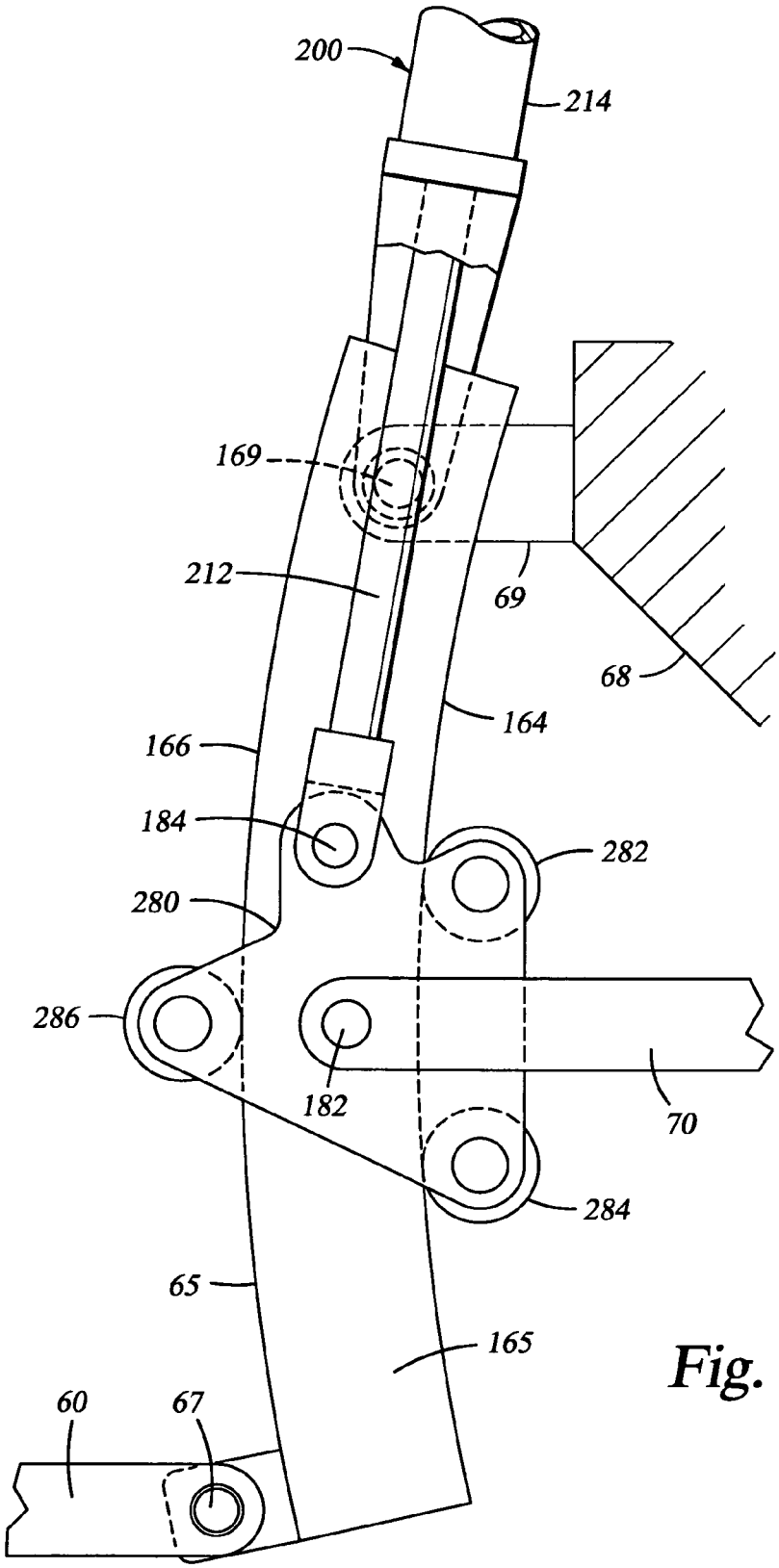
FIG. 5 is an enlarged, cross-sectional side view of a second embodiment of a slider comprising an external roller operatively connected to an actuator.

Referring now to FIGS. 3-5, the slider 80 of FIG. 1 can take a number of different forms. FIG. 3 and FIG. 4 depict a cross-sectional side view and a cross-sectional top view, respectively, of one embodiment of an internal slider block 180 disposed within an internal channel 165 of the variable stroke arc 65. As best depicted in FIG. 4, the internal slider block 180 is C-shaped, and connects to the cylinder rod 70 via a pivotal pin 182. The cylinder rod 70 extends through a front opening 167 that extends along the length of the variable stroke arc 65, and the cylinder rod 70 translates up and down within the opening 167 as the internal slider block 180 moves. Preferably, the internal slider block 180 is moved and then held in the desired position with respect to the variable stroke arc 65 by the actuator 200.

To position the internal slider block 180, the piston 212 of the shown actuator 200 may be extended to move the internal slider block 180 downwardly or may be retracted to move the internal slider block 180 upwardly within the channel 165 of the variable stroke arc 65. Thus, rather than manually setting the stroke length of the pump piston 12, the actuator 200 enables automated positioning of the internal slider block 180, which thereby sets the stroke length of the pump piston 12. Further, as one of ordinary skill in the art will readily appreciate, the actuator 200 may be operated via computer control and communication equipment to enable onsite or remote actuation.

FIG. 5 depicts a cross-sectional side view of another embodiment of slider 80, namely, an external roller 280 having rollers 282, 284, 286 that engage the outside surfaces 164, 166 of the variable stroke arc 65. The external roller 280 connects to the cylinder rod 70 via a pivotal pin 182. The cylinder rod 70 from the pivotal pin 182 of the external roller 280 disposed on the variable stroke arc 65, and the cylinder rod 70 translates up and down as the external roller 280 moves. Again, the external roller 280 is moveable to various positions along the variable stroke arc 65 via actuator 200 comprising a piston 212 disposed within a chamber 214. The positioning of the external roller 280 via the actuator 200 is the same as previously described with respect to the internal slider block 180 of FIGS. 3-4.

Referring again to FIG. 1, when operating the pump 10, the rate of delivery is controlled by the speed of rotation of the motor shaft 75 and the stroke length of the piston 12. In a generally rugged industrial environment, it is preferable to adjust the flow rate of a pump 10 by varying the piston stroke length using relatively simple mechanical linkages, such as linkage assembly 50, instead of varying the motor speed using a more complicated gear box, transmission, or variable speed drive. Thus, if the motor shaft 75 is rotated at a fixed speed by the motor 85, changes in the delivery rate of the pump 10 are made by varying the stroke length of the piston 12 by positioning the slider 80 to the desired position along the variable stroke arc 65.

Figure 6A:
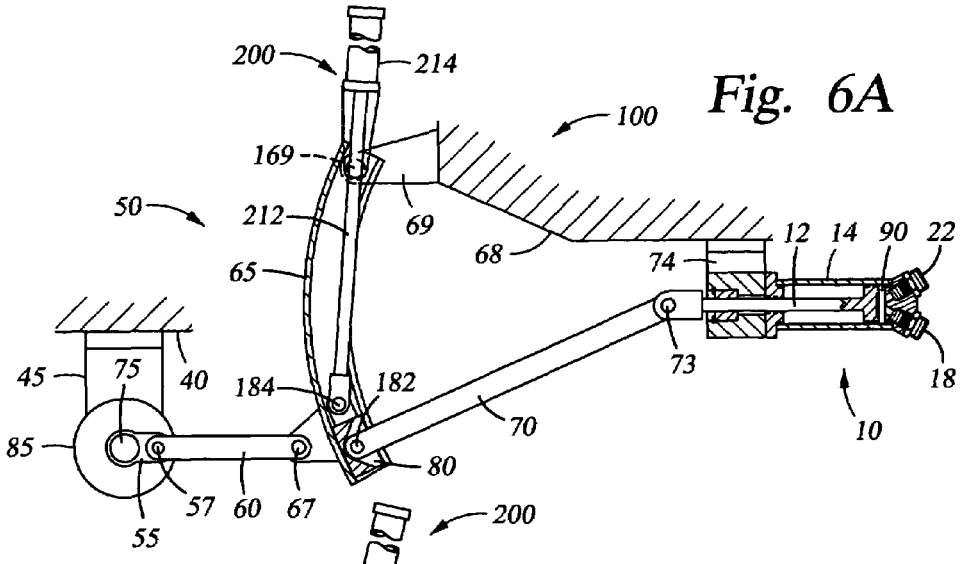
FIG. 6A-C is a series of cross-sectional side views showing the operation of the variable stroke assembly of FIG. 1 with the piston operating at full stroke length.
Figure 6B:
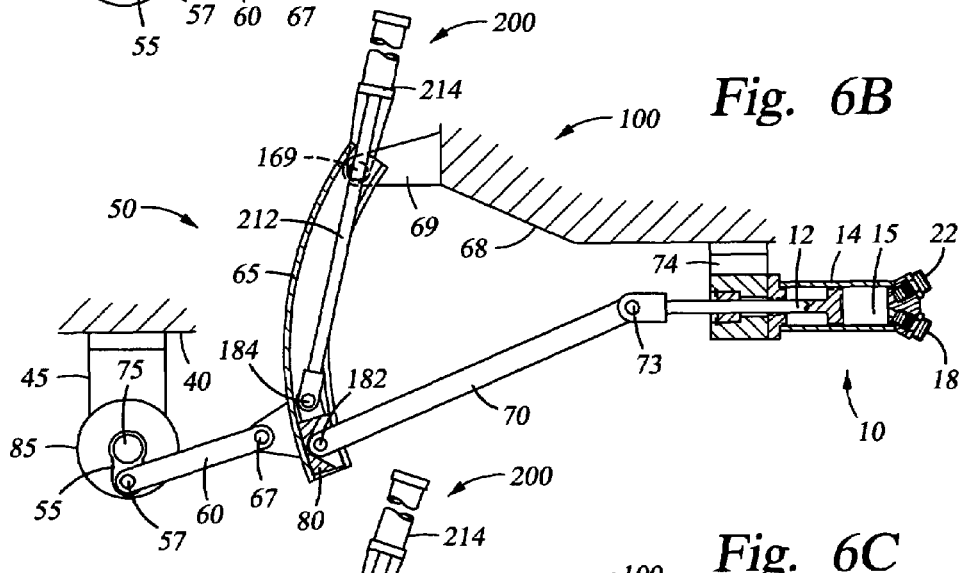
Figure 6C:
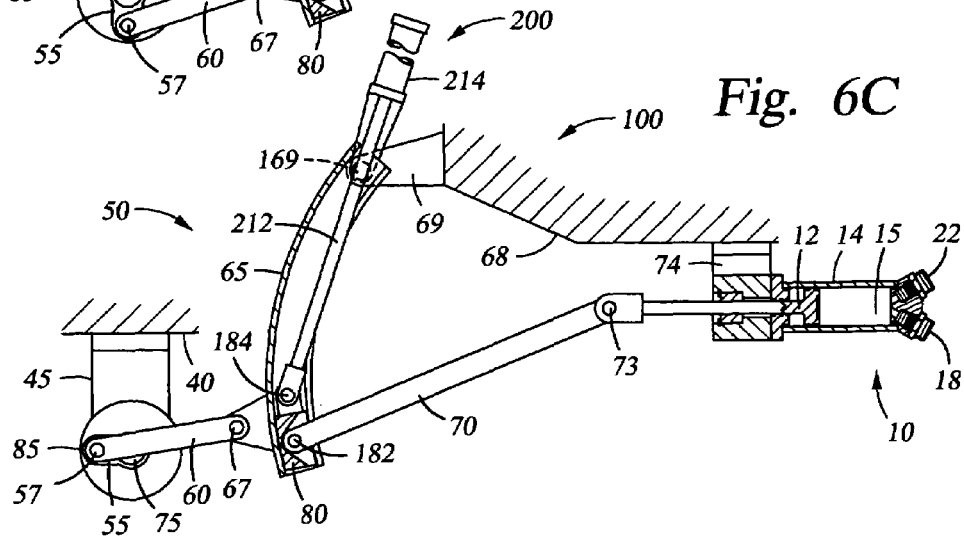

The maximum or full stroke length of the piston 12 is achieved when the slider 80 is positioned at the end of the variable stroke arc 65, opposite the pivotal connection 169. As depicted in FIGS. 6A-C, when the actuator piston 212 is fully extended, the slider 80 is positioned at the lower end of the variable stroke arc 65. The stroke length of the piston 12 can exceed the length of the crankshaft 55 when the pivotal pin 182 on the slider 80 is positioned beyond the pivotal connection 67 between the variable stroke arc 65 and the connecting rod 60. The slider 80 can be positioned while the motor shaft 75 is stationary or while it is being rotated.

FIGS. 6A-C depict, in 90° increments, the position of the variable stroke assembly 100 components for a 180° clockwise rotation of the crankshaft throw 55 about the motor shaft 75 with the piston 12 at its maximum stroke length. In particular, FIG. 6A depicts the piston 12 at its fully extended starting position, and FIGS. 6B-C depict the piston 12 on the suction stroke with fluid being drawn into the cylinder 14 through inlet port 18. As depicted, when the variable stroke arc 65 reciprocates, the actuator 200 pivots about the pivotal connection 169.

As the crankshaft throw 55 completes the remaining 180° rotation, the piston 12 extends on the pressure stroke and is returned to the fully extended starting position depicted in FIG. 6A. Even when the pump piston 12 is set to the maximum stroke length, the piston cylinder 14 is not fully evacuated during the pressure stroke, and a small, unswept volume 90 of fluid remains in the cylinder 14. To avoid operational problems with the pump 10 at high pressures, this unswept volume 90 should be held substantially constant, and preferably minimized, regardless of the stroke length of the piston 12.

In more detail, when operating in an oil service environment, for example, the positive displacement pump 10 may pump fluids, such as liquids, gels, foams, or gases, into existing oil wells to fracture the oil containing strata and increase oil production rates, or to cement a casing into place in the borehole, or to introduce a chemical into the drilling mud, or for a number of other purposes. In certain of these applications, such as fracturing, the positive displacement pump 10 will operate at relatively high pressures ranging from 3,000 to 10,000 pounds per square inch (psi), for example, and up to approximately 20,000 psi. At such high pressures, compressible fluids, such as liquefied gases, may become highly compressed, and even relatively incompressible liquids, such as water or gel, may act in a compressible manner. Thus, if the unswept volume 90 increases as the stroke length of the piston 12 decreases, some of the fluid can build up within the piston cylinder 14 such that as the piston 12 reciprocates, this fluid compresses and decompresses within the unswept volume area of the cylinder 14 without actually leaving the pump 10. Thus, the pump 10 will become increasingly ineffectual and pump successively less and less fluid as the stroke is decreased with a corresponding increase in unswept volume.

Accordingly, for the positive displacement pump 10 to function properly at such high pressures, the variable stroke assembly 100 may be designed so as to maintain a substantially constant, and preferably minimized, unswept volume 90, regardless of the stroke length of the piston 12, so as to avoid a build-up of fluid within the piston cylinder 14.

To ensure that the variable stroke assembly 100 is designed to maintain a substantially constant unswept volume 90 for all stroke lengths, the piston 12 should begin the suction stroke and complete the pressure stroke in the same position, and preferably the fully extended position of the piston 12 to minimize the unswept volume 90 as shown in FIG. 6A. With a cylinder rod 70 of length "L" and the piston 12 at the fully extended, maximum stroke length position as depicted in FIG. 6A, the radius of the variable stroke arc 65 should equal length "L", the pivotal connection 169 on the variable stroke arc 65 should be located distance "L" from the pivotal connection 73 between the cylinder rod 70 and the piston 12, and the pivotal pin 182 on the slider 80 should be located distance "L" from pivotal connection 73. With this configuration, the variable stroke arc 65 will ensure that the piston 12 ends the pressure stroke in the same, fully extended position regardless of the piston stroke length.

Figure 7A:
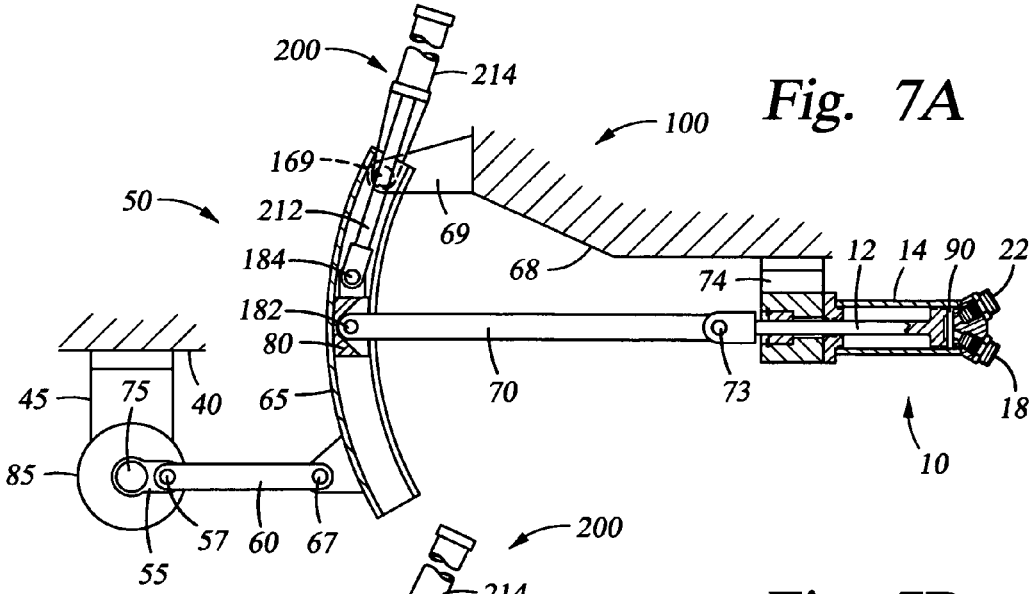
FIG. 7A-C is a series of cross-sectional side views showing the operation of the variable stroke assembly of FIG. 1 with the piston operating at half stroke length.
Figure 7B:
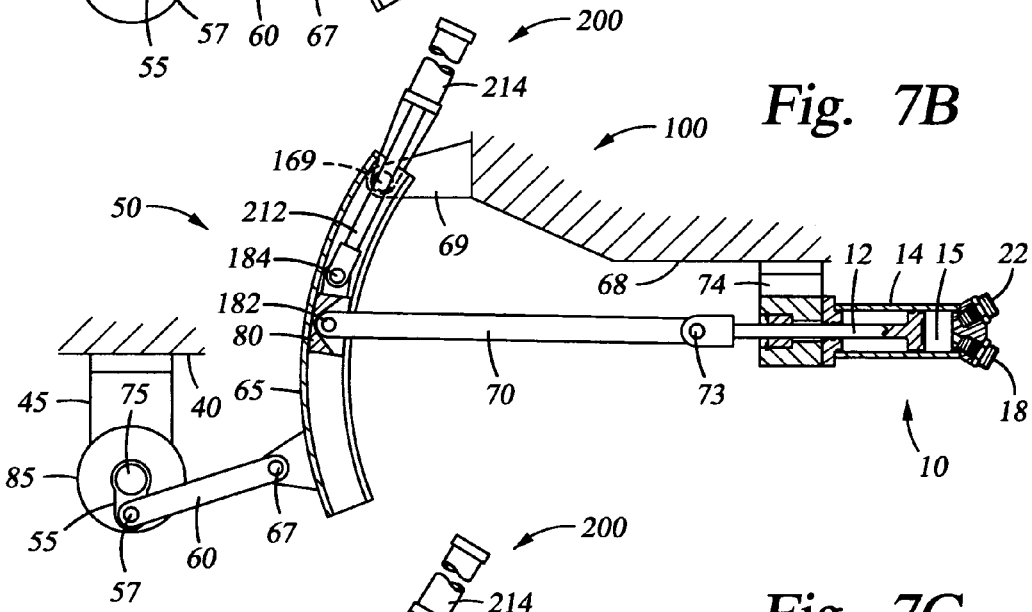
Figure 7C:
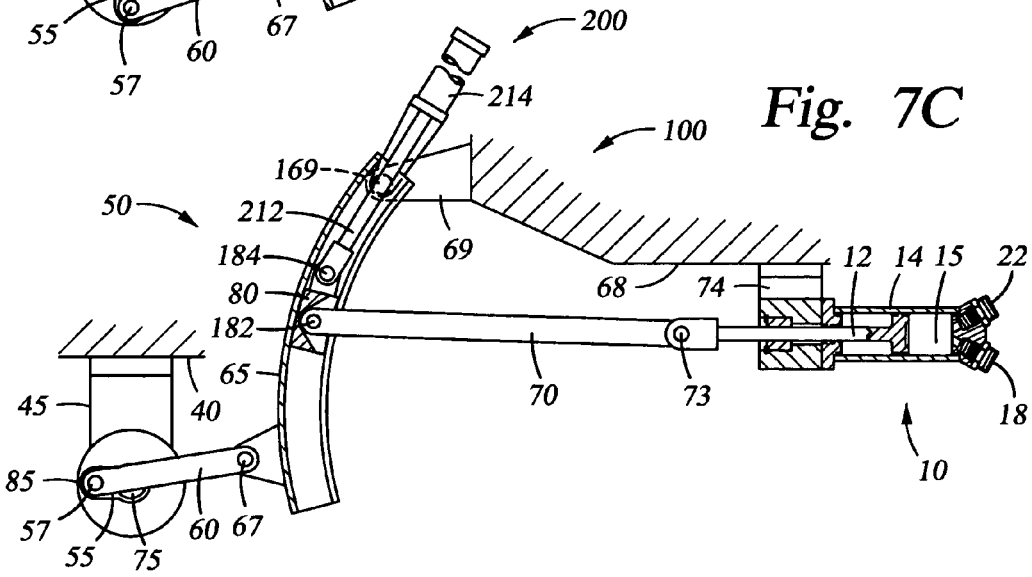

The stroke length of the piston 12 is reduced by translating the slider 80 upwardly along the variable stroke arc 65 from the maximum stroke length position of FIGS. 6A-C. The slider 80 is moveable to any point along the variable stroke arc 65 rather than only being moveable to predetermined locations along the arc 65. Thus, by retracting the actuator piston 212 to move the slider 80 to the mid-point on the variable stroke arc 65 as depicted in FIGS. 7A-C, the piston stroke length is reduced to half of the maximum. FIGS. 7A-C depict, in 90° increments, the position of the variable stroke assembly 100 components for a 180° clockwise rotation of the crankshaft throw 55 about the motor shaft 75 with the piston 12 at half stroke length. In particular, FIG. 7A depicts the piston 12 at the fully extended starting position, and FIGS. 7B-C depict the piston on the suction stroke with fluid being drawn into the cylinder 14 through inlet port 18. The piston 12 only retracts to the mid-point of the cylinder 14 when the piston 12 is set at half stroke length. As depicted, when the variable stroke arc 65 reciprocates, the actuator 200 pivots about the pivotal connection 169. Again, as the crankshaft throw 55 completes the remaining 180° rotation, the piston 12 extends on the pressure stroke and is returned to the fully extended starting position depicted in FIG. 7A. Thus, the variable stroke assembly 100 may be designed so that the pump 10 will complete the pressure stroke of the piston 12 in the fully extended position, regardless of the piston stroke length, so as to maintain a substantially constant unswept volume 90.

Figure 8A:
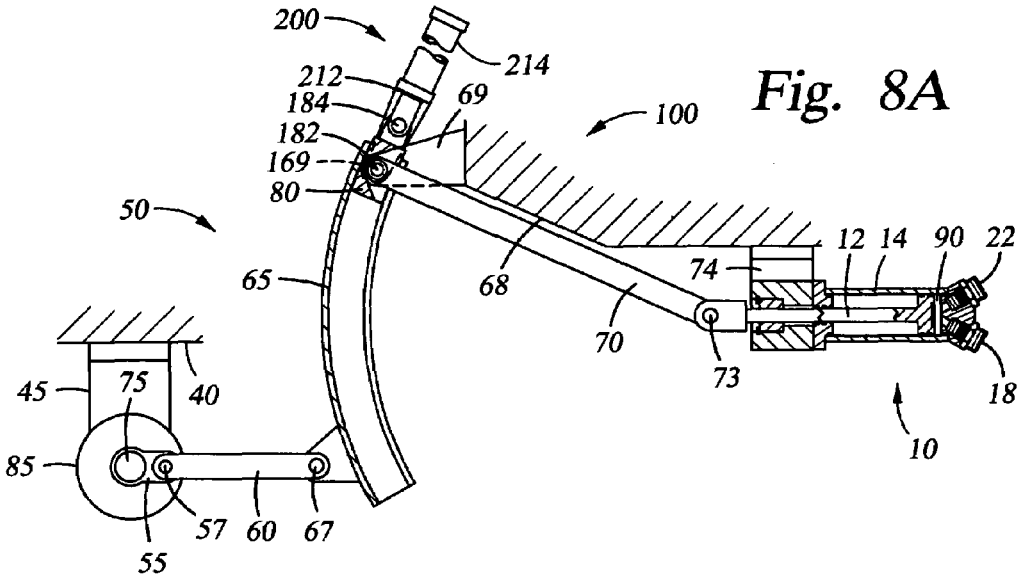
FIG. 8A-B is a series of cross-sectional side views showing the operation of the variable stroke assembly of FIG. 1 with the piston operating at zero stroke length.
Figure 8B:
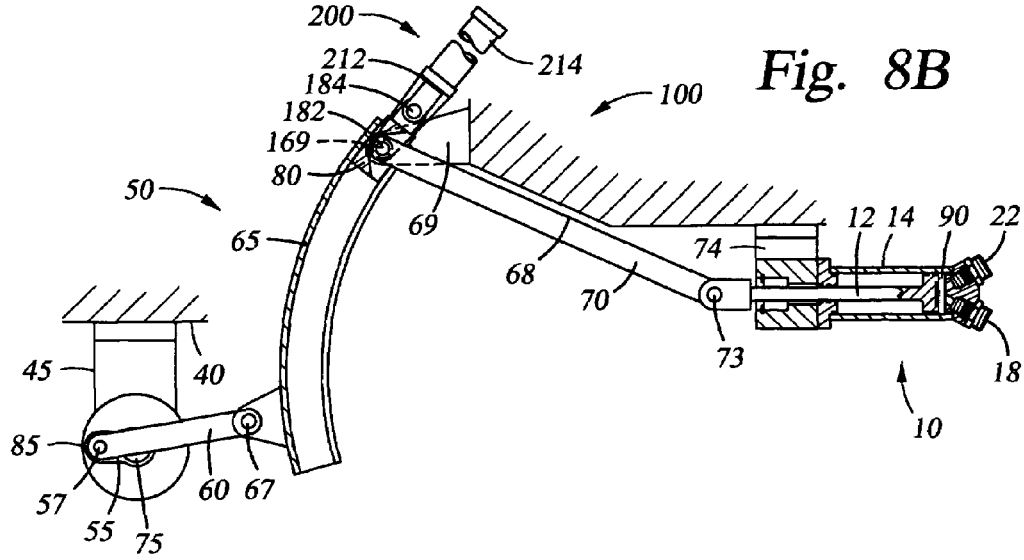

The minimum or zero stroke length of the piston 12 is achieved by fully retracting the actuator piston 212 to move the slider 80 to the opposite end of the variable stroke arc 65 at the pivotal connection 169 with the bracket 69 as shown in FIGS. 8A-8B. FIGS. 8A-B depict the position of the variable stroke assembly 100 components for a 180° clockwise rotation of the crankshaft throw 55, with the piston 12 at zero stroke length. In particular, as the components of the linkage assembly 50 respond to the rotation of the motor shaft 75, the piston 12 remains stationary within the cylinder 14 at the zero stroke length setting.

In other applications, it may be desirable for the variable stroke assembly 100 to achieve other than a substantially constant unswept volume 90. For such applications, the length of one or more components of the linkage assembly 50 may be altered to achieve a desired result. For example, in an engine application, a substantially constant compression ratio is desirable. A compression ratio is the ratio of the total volume in the piston cylinder 14 to the unswept volume in the piston cylinder 14. To maintain a substantially constant compression ratio, the unswept volume must be proportionally variable to the total volume as the stroke length of the piston 12 is altered.

The inventors have discovered that one way to achieve a substantially constant compression ratio is to decrease the length of the connecting rod 60 while keeping all other dimensions of the variable stroke assembly 100 the same as described above for the substantially constant unswept volume configuration. A shorter connecting rod 60 prevents the piston 12 from extending to the maximum stroke length position depicted in FIGS. 6A, 7A, and 8A-B. The actual length of the connecting rod 60 would be determined by configuring the variable stroke assembly 100 for no unswept volume with the slider 80 positioned so that the piston 12 is at zero stroke length, then setting the slider 80 to a position where the piston 12 is at some known stroke length, and shortening the connecting rod 60 to achieve the desired compression ratio with piston 12. Once the connecting rod 60 length is set, the compression ratio will remain substantially constant regardless of the stroke length of the piston 12, until the stroke length approaches zero. With the slider 80 positioned so that the piston 12 is at zero stroke length, there is no compression, so the compression ratio is undefined. However, substantially constant compression ratios in normal ranges, such as 8:1 for modem automobile engines and 12:1 for racecar engines, are readily achievable at non-zero stroke lengths. Therefore, as the slider 80 is moved along the variable stroke arc 65 to modify the stroke length of the piston 12, the compression ratio would remain substantially constant for a given shortened length of connecting rod 60.

Figure 9:
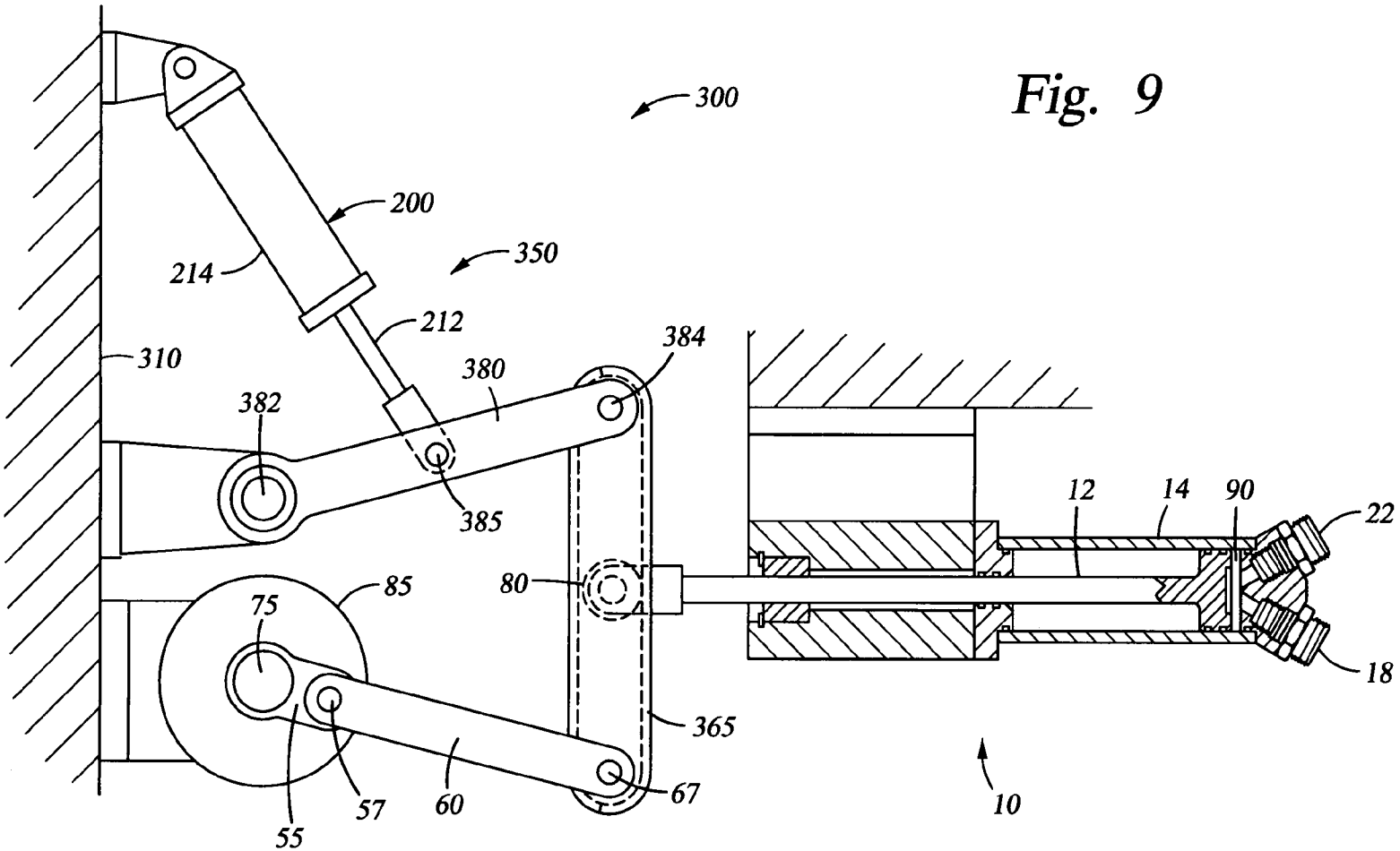
FIG. 9 is a cross-sectional side view of a second embodiment of a variable stroke assembly for varying the stroke length of a piston within a single positive displacement pump connected to a pump motor.

Referring now to FIG. 9, a cross-sectional side view is depicted of a second embodiment of variable stroke assembly, generally designated as 300, comprising the same single positive displacement pump 10 and an alternate linkage assembly 350 for varying the piston stroke length. Many components of the second variable stroke assembly 300 are the same as the components of the first variable stroke assembly 100, and those components maintain the same reference numerals. However, in the second variable stroke assembly 300, the cylinder rod 70 has been eliminated, the variable stroke arc 65 has been replaced with a linear variable stroke member 365, and a positioning member 380 has been added. The pump piston 12 connects directly to a slider 80 that traverses the linear variable stroke member 365, and the slider 80 may comprise, for example, the internal slider block 180, or the external roller 280, or any other suitable configuration. The positioning member 380 rotates about a pivotal connection 382 to a support 310, and at an opposing end makes a pivotal connection 384 to the linear variable stroke member 365. In the second variable stroke assembly 300, the actuator 200 is connected at pivot 385 to the positioning member 380 rather than being connected to the slider 80.

Figure 10A:
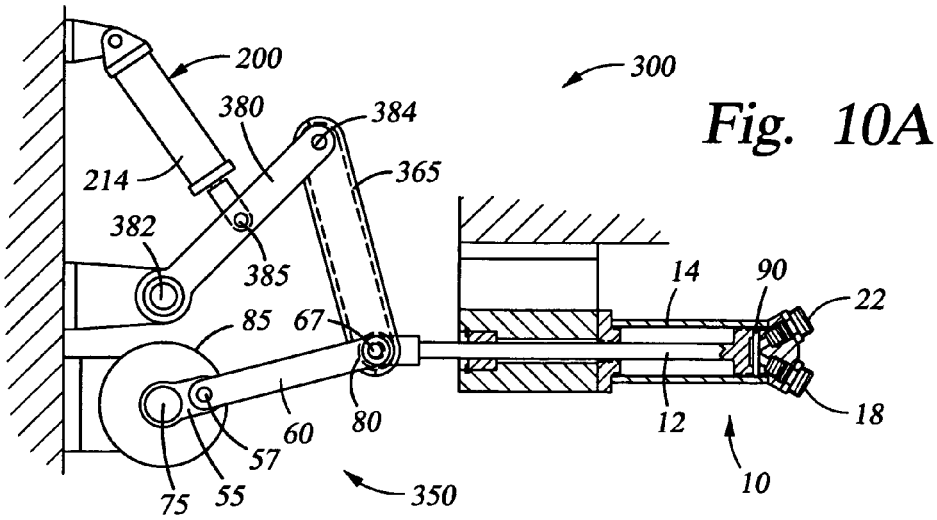
FIG. 10A-C is a series of cross-sectional side views showing the operation of the variable stroke assembly of FIG. 9 with the piston operating at full stroke length.
Figure 10B:
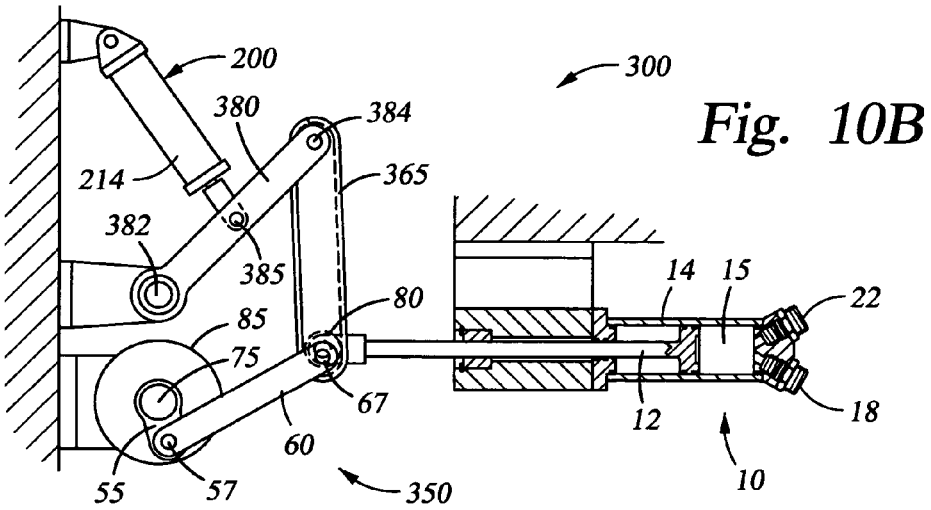
Figure 10C:
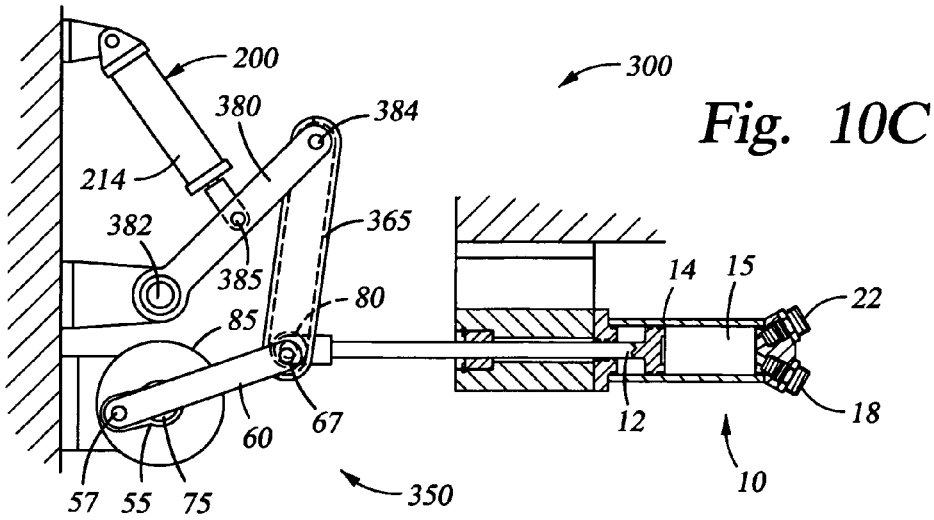

The maximum or full stroke length of the piston 12 is achieved when the slider 80 is positioned at the end of the linear variable stroke member 365 adjacent the pivotal connection 67 to the connecting rod 60. To position the slider 80, the actuator piston 212 is retracted or extended. In more detail, as the actuator piston 212 extends or retracts, the positioning member 380 pivots about the pivotal connection 382, and the linear variable stroke member 365 will be raised or lowered, such that the slider 80, which connects directly to the pump piston 12, translates along the linear variable stroke member 365. As depicted in FIG. 10A-C, when the actuator piston 212 is fully retracted, the slider 80 is positioned at the end of the linear variable stroke member 365 adjacent the pivotal connection 67, corresponding to the maximum stroke length of the piston 12. FIGS. 10A-C depict, in 90° increments, the position of the variable stroke assembly 300 components for a 180° clockwise rotation of the crankshaft throw 55 about the motor shaft 75 with the piston 12 at its maximum stroke length. In particular, FIG. 10A depicts the piston 12 at the starting position, and FIGS. 10B-C depict the piston on the suction stroke with fluid being drawn into the cylinder 14 through inlet port 18. As the crankshaft throw 55 completes the remaining 180° rotation, the piston 12 extends on the pressure stroke and is returned to the fully extended starting position depicted in FIG. 10A.

Figure 11A:
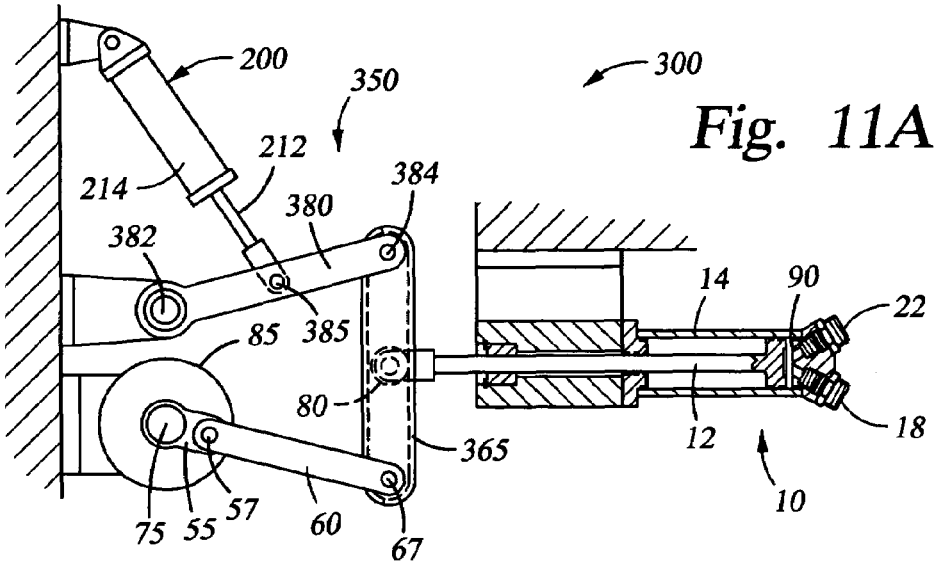
FIG. 11A-C is a series of cross-sectional side views showing the operation of the variable stroke assembly of FIG. 9 with the piston operating at half stroke length.
Figure 11B:
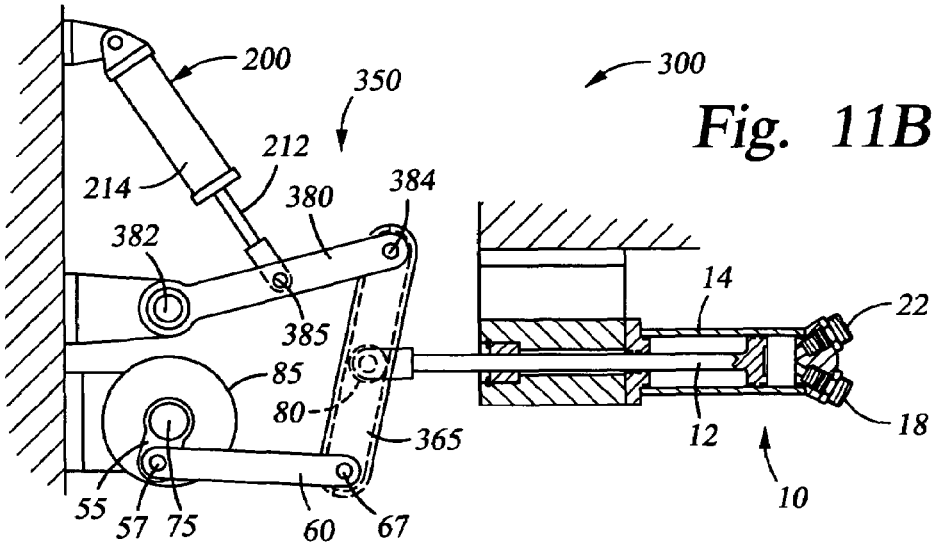
Figure 11C:
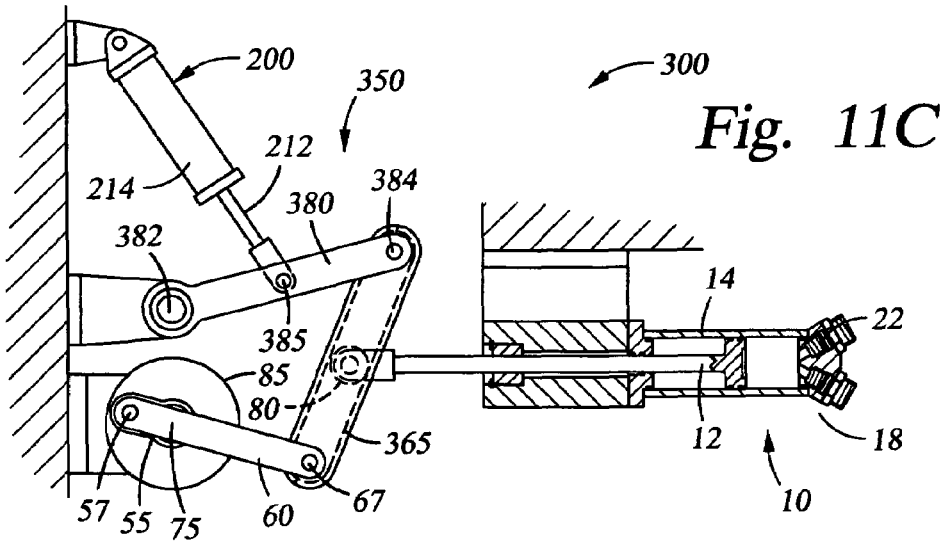

As the slider 80 is translated upwardly along the linear variable stroke member 365 from the maximum stroke position of FIGS. 10A-C, the stroke length of the piston 12 is reduced. By extending the actuator piston 212, the slider 80 is moveable to any point along the linear variable stroke member 365 rather than only being moveable to predetermined locations along the member 365. Thus, by extending the actuator piston 212 to move the slider 80 to the mid-point on the linear variable stroke member 365, as depicted in FIGS. 11A-C, the piston stroke length is reduced to half of the maximum. FIGS. 11A-C depict, in 90° increments, the position of the variable stroke assembly 300 components for a 180° clockwise rotation of the crankshaft throw 55 about the motor shaft 75 with the piston 12 at half stroke length. In particular, FIG. 11A depicts the piston 12 at the starting position, and FIGS. 11B-C depict the piston on the suction stroke with fluid being drawn into the cylinder 14 through inlet port 18. As the crankshaft throw 55 completes the remaining 180° rotation, the piston 12 extends on the pressure stroke and is returned to the fully extended starting position depicted in FIG. 11A. Thus, the variable stroke assembly 300 may be designed such that the pump 10 will complete the pressure stroke of the piston 12 in the fully extended position, regardless of the piston stroke length, so as to maintain a substantially constant unswept volume 90.

Figure 12A:
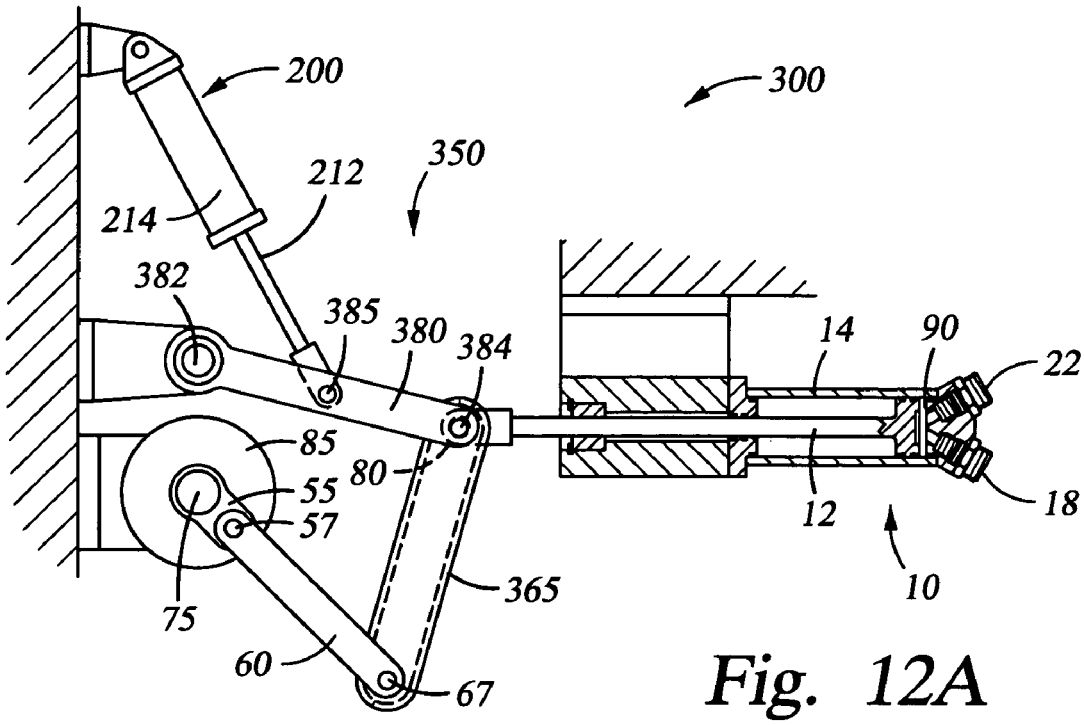
FIG. 12A-B is a series of cross-sectional side views showing the operation of the variable stroke assembly of FIG. 9 with the piston operating at zero stroke length
Figure 12B:
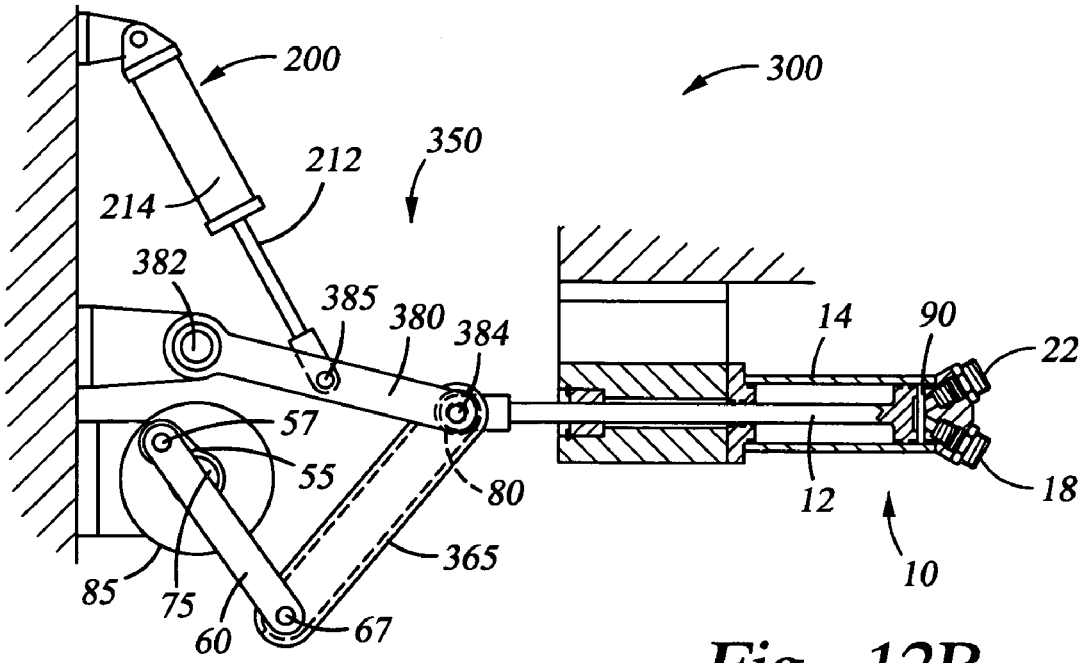

The minimum or zero stroke length of the piston 12 is achieved by extending the actuator piston 212 to move the slider 80 to the opposite end of the linear variable stroke member 365, adjacent the pivotal connection 384 with the positioning member 380. FIGS. 12A-B depict the position of the variable stroke assembly 300 components for a 180° clockwise rotation of the crankshaft throw 55, with the piston 12 at zero stroke length. In particular, as the components of the linkage assembly 350 respond to the rotation of the motor shaft 75, the piston 12 remains stationary within the cylinder 14 at the zero stroke length setting.

As previously described, for a piston-type positive displacement pump 10 to function properly at high pressures, the variable stroke assembly 300 may be designed to maintain a substantially constant, and preferably minimized, unswept volume 90, regardless of the stroke length of the piston 12 so as to avoid a build-up of fluid within the piston cylinder 14 that is not discharged from the pump 10. To maintain a substantially constant unswept volume 90 for all displacements, the sum of the crankshaft throw 55 length and the connecting rod 60 length should equal the positioning member 380 length. Further, the length of the linear variable stroke member 365 should equal twice the distance between the motor shaft 75 and the pivotal connection 382. Given these parameters, the slider 80 will always fall on the intersection between a first circle that would be swept by the positioning member 380 rotating about the pivotal connection 382, and a second circle that would be swept by the combination of the crankshaft throw 55 and the connecting rod 60 rotating about the motor shaft 75. With the slider 80 positioned at the intersection of the first and second circles, a substantially constant unswept volume 90 will be maintained for all piston stroke lengths. Accordingly, as depicted in FIGS. 10, 11A, and 12A-B, the variable stroke assembly 300 may be designed such that the pump 10 will complete the pressure stroke of the piston 12 in the same, preferably fully extended position, regardless of the piston stroke length, so as to maintain a substantially constant unswept volume 90.

In other applications, it may be desirable for the variable stroke assembly 300 to achieve other than a substantially constant unswept volume 90. For such applications, the length of one or more components of the linkage assembly 350 may be altered to achieve a desired result. For example, in an engine application, a substantially constant compression ratio is desirable, which can be achieved by decreasing the length of the connecting rod 60 while keeping all other dimensions of the variable stroke assembly 300 the same as described above for the substantially constant unswept volume configuration. A shorter connecting rod 60 prevents the piston 12 from extending to the maximum stroke length position. The actual length of the connecting rod 60 would be determined by configuring the variable stroke assembly 300 for no unswept volume with the slider 80 positioned so that the piston 12 is at zero stroke length, then setting the slider 80 to a position where the piston 12 is at some known stroke length, and shortening connecting rod 60 to achieve the desired compression ratio with piston 12. Once the connecting rod 60 length is set, the compression ratio will remain substantially constant regardless of the stroke length of the piston 12, until the stroke length approaches zero. With the slider 80 positioned so that the piston 12 is at zero stroke length, there is no compression, so the compression ratio is undefined. However, substantially constant compression ratios in normal ranges, such as 8:1 for modem automobile engines and 12:1 for racecar engines, are readily achievable at non-zero stroke lengths. Therefore, as the slider 80 is moved along the linear variable stroke member 365 to modify the stroke length of the piston 12, the compression ratio would remain substantially constant for a given shortened length of connecting rod 60.

Figure 13:
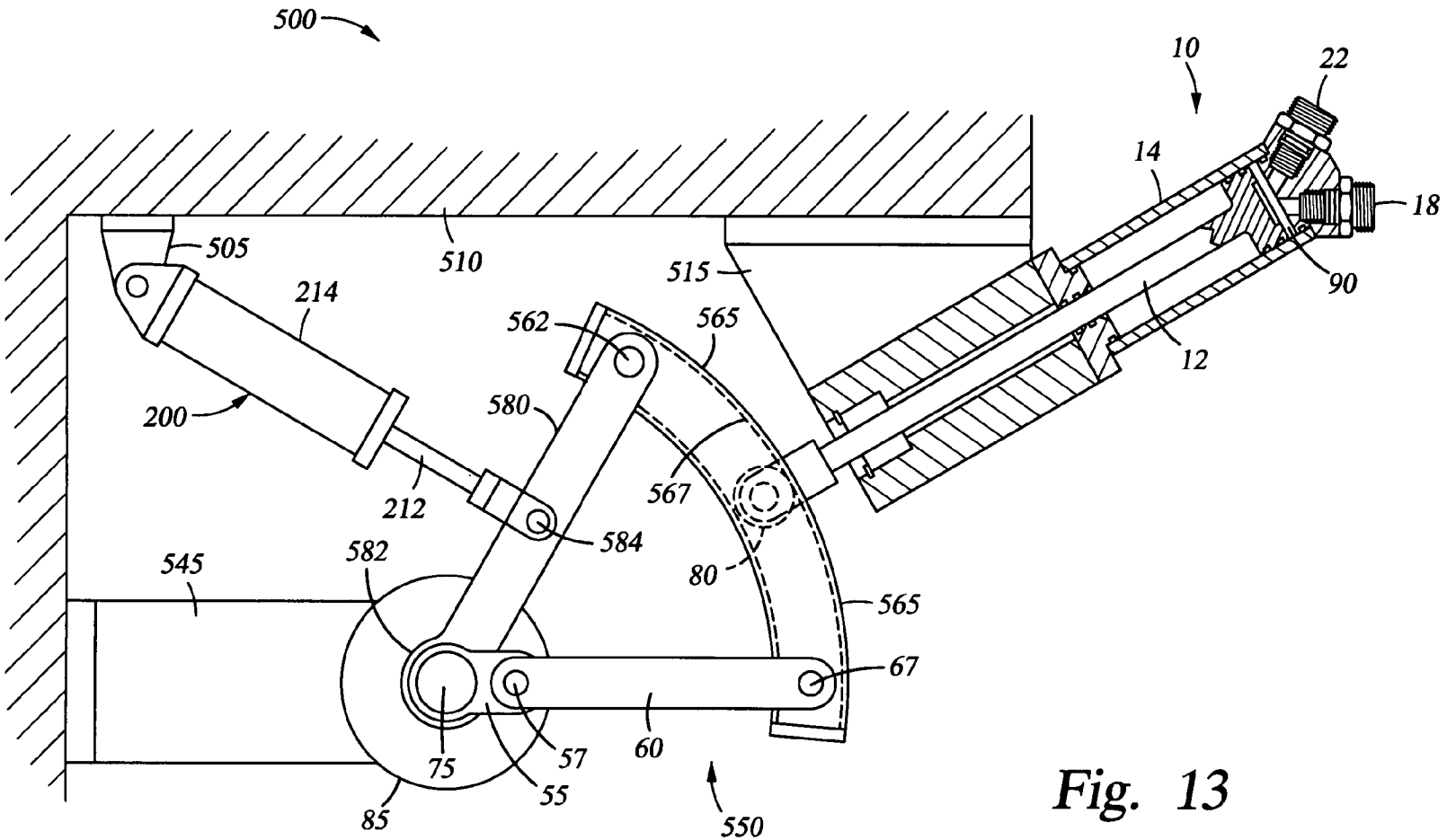
FIG. 13 is a cross-sectional side view of a third embodiment of a variable stroke assembly for varying the stroke length of a piston within a single positive displacement pump connected to a pump motor.

Referring now to FIG. 13, a cross-sectional side view is depicted of a third embodiment of a variable stroke assembly, generally designated as 500, comprising the same single positive displacement pump 10 and an alternate linkage assembly 550 for varying the piston stroke length. Many components of the third variable stroke assembly 500 are the same as the components of the first and second variable stroke assemblies 100, 300, and those components maintain the same reference numerals. However, in the third variable stroke assembly 500, the variable stroke arc 65 has been replaced with a variable stroke curve 565, and the positioning member 380 has been replaced with a positioning rod 580. The pump piston 12 connects directly to the slider 80, which may comprise, an internal roller that traverses within a channel 567 in the variable stroke curve 565, as depicted, or may alternately comprise the internal slider block 180, or the external roller 280, or any other suitable configuration. The actuator 200 is secured at bracket 505 to a support 510, and the pump 10 is secured at bracket 515 to the support 510. The positioning rod 580 forms a pivotal connection 562 to the variable stroke curve 565, and on the opposing end the positioning rod 580 forms a pivotal connection 582 to the crankshaft throw 55. In the third variable stroke assembly 500, the actuator 200 is pivotally connected at 584 to the positioning rod 580.

Figure 14A:
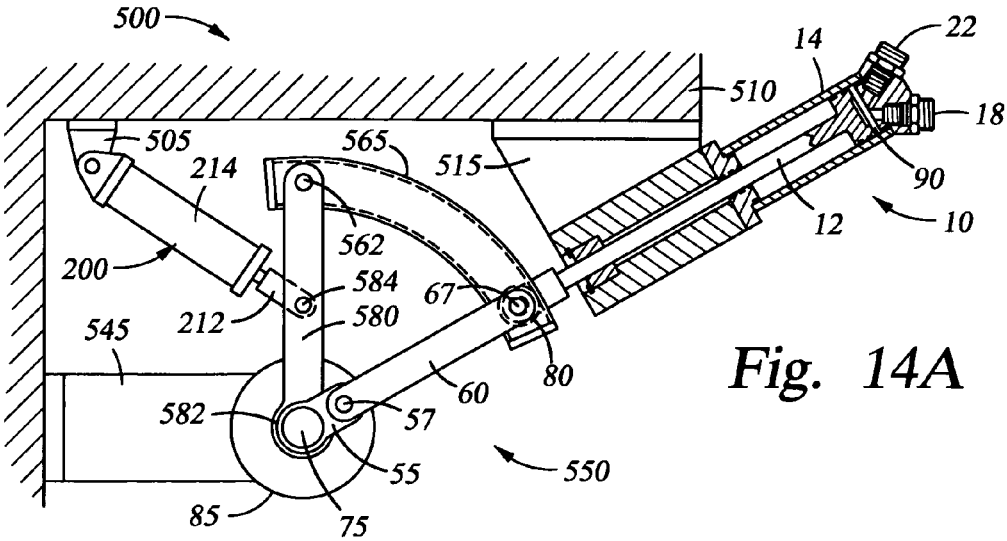
FIG. 14A-C is a series of cross-sectional side views showing the operation of the variable stroke assembly of FIG. 13 with the piston operating at full stroke length.
Figure 14B:
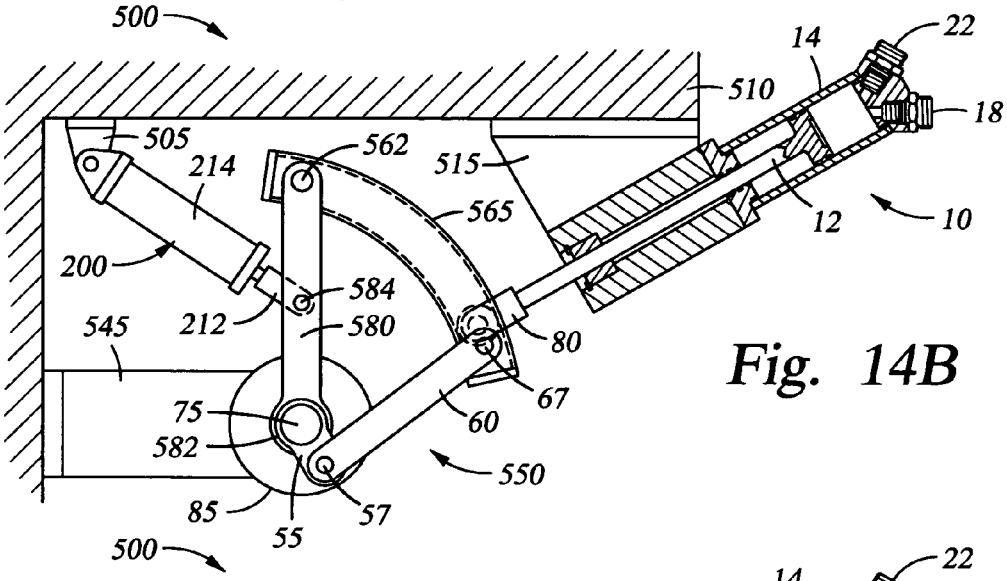
Figure 14C:
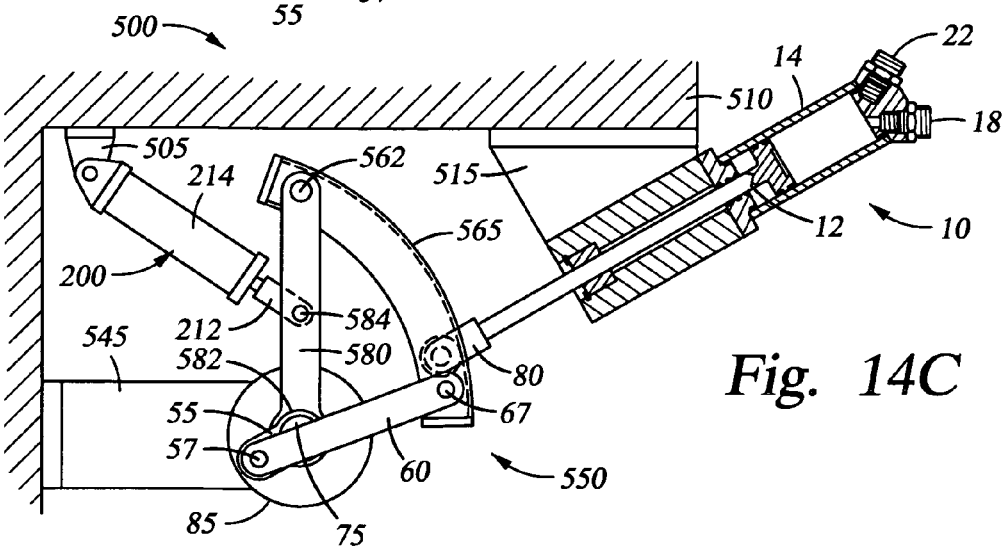

The maximum or full stroke length of the piston 12 is achieved when the slider 80 is positioned at the end of the variable stroke curve 565 adjacent the pivotal connection 67 with the connecting rod 60. To position the slider 80, the actuator piston 212 is retracted or extended. In more detail, as the actuator piston 212 extends or retracts, it pivots the positioning rod 580, the variable stroke curve 565, and the connecting rod 60 as a unit about the center of the motor shaft 75 at pivotal connection 582. Thus, as the variable stroke curve 565 is rotated, the slider 80, which connects directly to the pump piston 12, traverses the variable stroke curve 565. As depicted in FIGS. 14A-C, when the actuator piston 212 is fully retracted, the slider 80 is positioned at the end of the variable stroke arc 65 corresponding to the maximum stroke length of the piston 12. FIGS. 14A-C depict the position of the variable stroke assembly 500 components for a 180° clockwise rotation of the crankshaft throw 55, with the piston 12 at its maximum stroke length. In particular, FIGS. 14A-C depict the piston 12 on the suction stroke with fluid being drawn into the cylinder 14 through inlet port 18. As the crankshaft throw 55 completes its rotation the remaining 180°, the piston 12 extends on the pressure stroke to be returned to the position depicted in FIG. 14A.

Figure 15A:
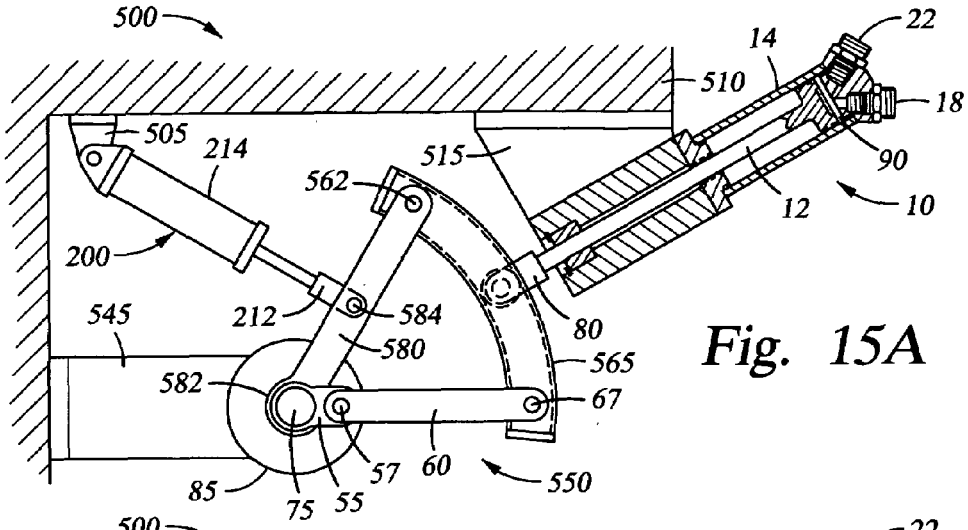
FIG. 15A-C is a series of cross-sectional side views showing the operation of the variable stroke assembly of FIG. 13 with the piston operating at half stroke length.
Figure 15B:
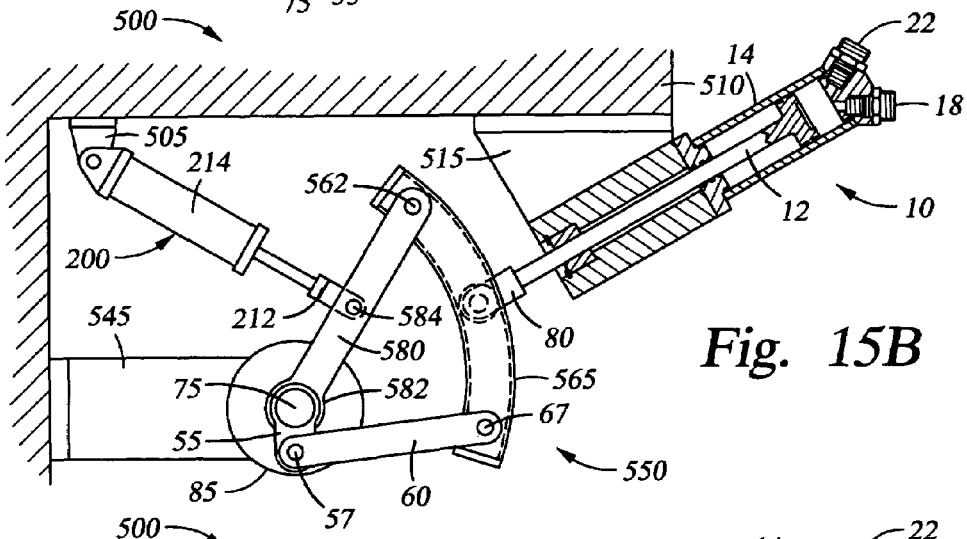
Figure 15C:
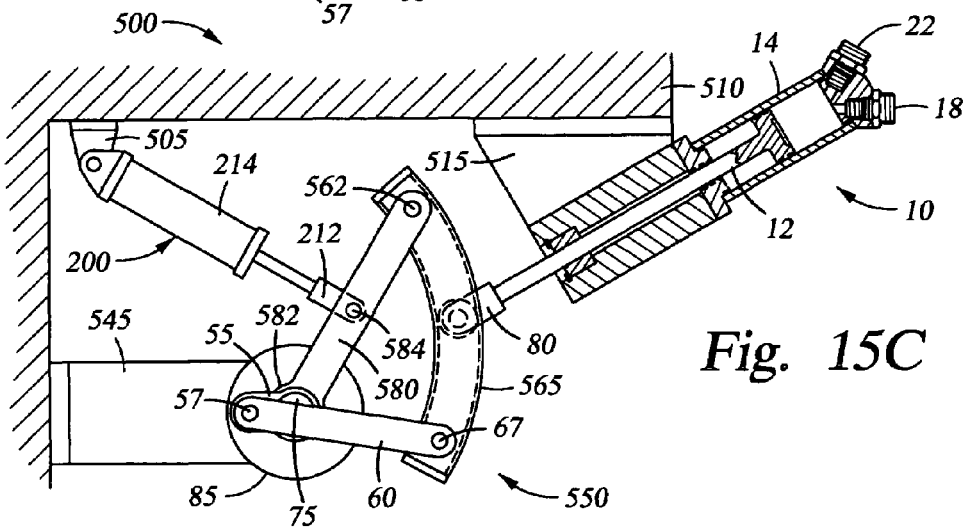

As the slider 80 traverses the variable stroke curve 565 away from the maximum stroke position of FIGS. 14A-C, the stroke length of the piston 12 is reduced. By extending the actuator piston 212, the slider 80 is moveable to any point along the variable stroke curve 565 rather than only being moveable to predetermined locations along the curve 565. Thus, by extending the actuator piston 212 to pivot the positioning rod 580, the variable stroke curve 565, and the connecting rod 60 to the position depicted in FIGS. 15A-C, the slider 80 is moved to the mid-point on the variable stroke curve 565, and the piston stroke length is thereby reduced to half of the maximum. FIGS. 15A-C depict, in 90° increments, the position of the variable stroke assembly 500 components for a 180° clockwise rotation of the crankshaft throw 55, with the piston 12 at half stroke length. In particular, FIGS. 15A-C depict the position of the piston 12 on the suction stroke with fluid being drawn into the cylinder 14 through inlet port 18. As the crankshaft throw 55 completes its rotation the remaining 180°, the piston 12 would be extended on the pressure stroke and returned to the position depicted in FIG. 15A.

Figure 16A:
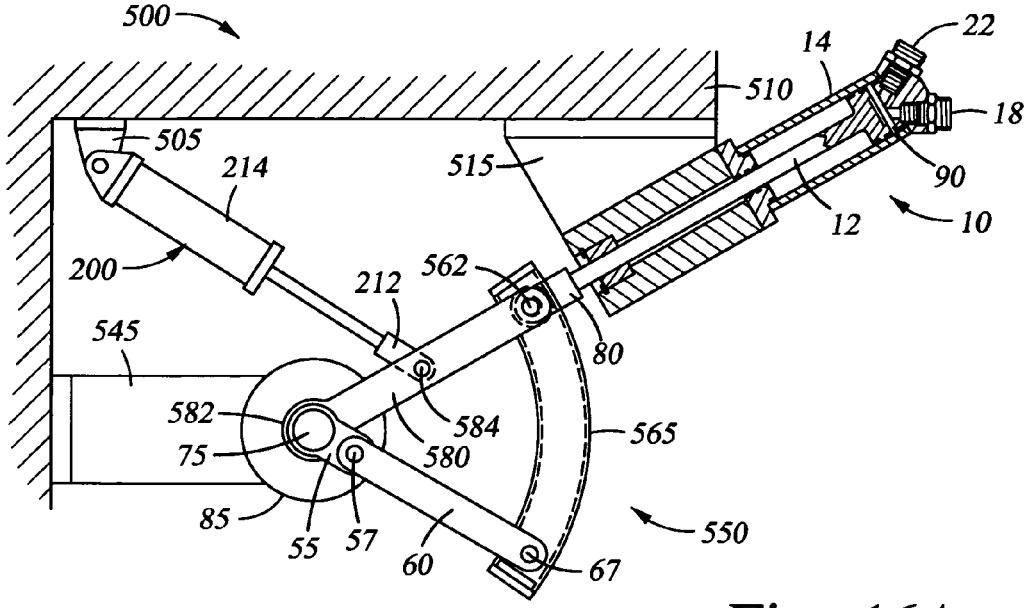
FIG. 16A-B is a series of cross-sectional side views showing the operation of the variable stroke assembly of FIG. 13 with the piston operating at zero stroke length.
Figure 16B:
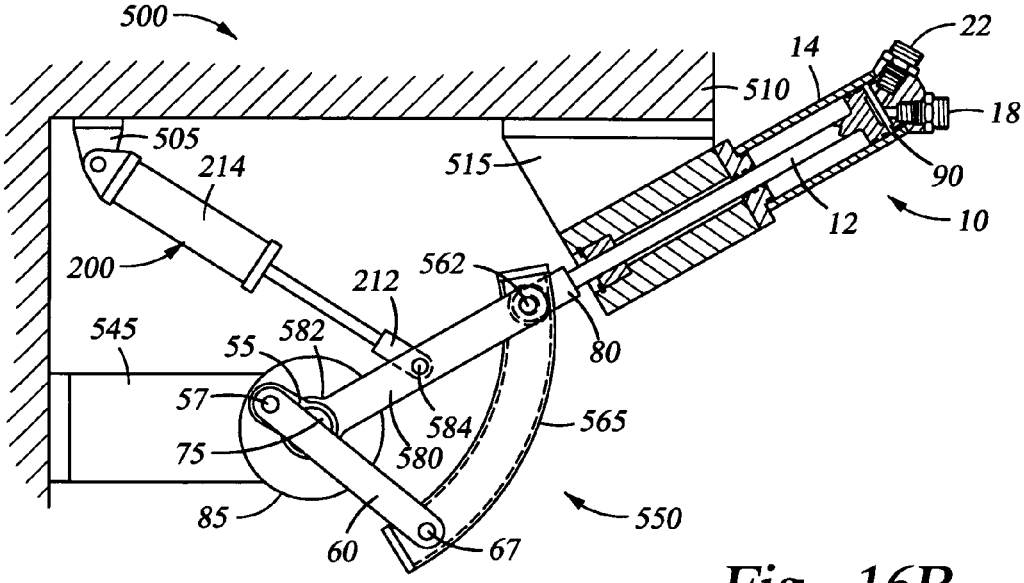

The minimum or zero stroke length of the piston 12 is achieved by moving the slider 80 to the opposite end of the variable stroke curve 565, adjacent the pivotal connection 562 with the positioning rod 580. This is achieved by fully extending the actuator piston 212 to rotate the positioning rod 580, the variable stroke curve 565 and the connecting rod 60 to the position shown in FIGS. 16A-B. FIGS. 16A-B depict the position of the variable stroke assembly 500 components for a 180° clockwise rotation of the crankshaft throw 55, with the piston 12 at zero stroke length. In particular, as the components of the linkage assembly 550 respond to the rotation of the motor shaft 75, the piston 12 remains stationary within the cylinder 14 at the zero stroke length setting.

As previously described, for a piston-type positive displacement pump 10 to function properly at high pressures, the variable stroke assembly 500 may be designed to maintain a substantially constant, and preferably minimized, unswept volume 90, regardless of the stroke length of the piston 12 so as to avoid a build-up of fluid within the piston cylinder 14 that does not get discharged from the pump 10. To maintain a substantially constant unswept volume 90 for all displacements, the connecting rod 60 length should be at least twice the length of the crankshaft throw 55, the positioning rod 580 length should equal the sum of the crankshaft throw 55 length and the connecting rod 60 length, the variable stroke curve 565 should be less than twice the length of the connecting rod 60, and the radius of the variable stroke curve 565 should equal the positioning member 580 length. Given these parameters, a substantially constant unswept volume 90 will be maintained for all stroke lengths. Accordingly, as depicted in FIG. 14A, FIG. 15A and FIGS. 16A-B, the variable stroke assembly 500 may be designed such that the pump 10 will complete the pressure stroke of the piston 12 in the same, preferably fully extended position, regardless of the piston stroke length, so as to maintain a substantially constant unswept volume 90.

In other applications, it may be desirable for the variable stroke assembly 500 to achieve other than a substantially constant unswept volume 90. For such applications, the length of one or more components of the linkage assembly 550 may be altered to achieve a desired result. For example, in an engine application, a substantially constant compression ratio is desirable, which can be achieved by decreasing the length of the connecting rod 60 while keeping all other dimensions of the variable stroke assembly 500 the same as described above for the substantially constant unswept volume configuration. A shorter connecting rod 60 prevents the piston 12 from extending to the maximum stroke length position. The actual length of the connecting rod 60 would be determined by configuring the variable stroke assembly 500 for no unswept volume with the slider 80 positioned so that the piston 12 is at zero stroke length, then setting the slider 80 to a position where the piston 12 is at some known stroke length, and shortening the connecting rod 60 to achieve the desired compression ratio with piston 12. Once the connecting rod 60 length is set, the compression ratio will remain substantially constant regardless of the stroke length of the piston 12, until the stroke length approaches zero. With the slider 80 positioned so that the piston 12 is at zero stroke length, there is no compression, so the compression is undefined. However, substantially constant compression ratios in normal ranges, such as 8:1 for modem automobile engines and 12:1 for racecar engines, are readily achievable for non-zero stroke lengths. Therefore, as the slider 80 is moved along the variable stroke curve 565 to modify the stroke length of the piston 12, the compression ratio would remain substantially constant for a given shortened length of connecting rod 60.

While various embodiments of the invention have been shown and described herein, modifications may be made by one skilled in the art without departing from the spirit and the teachings of the invention. The embodiments described here are exemplary only, and are not intended to be limiting. Many variations, combinations, and modifications of the invention disclosed herein are possible and are within the scope of the invention. Accordingly, the scope of protection is not limited by the description set out above, but is defined by the claims which follow, that scope including all equivalents of the subject matter of the claims.

What is claimed is:

1. A variable stroke assembly comprising an actuatable linkage assembly operatively connected to a piston for varying the piston stroke length, wherein the linkage assembly comprises:

a variable stroke component; and a slider connecting the variable stroke component to the piston and configured to vary the stroke length of the piston, wherein a substantially constant unswept volume or a substantially constant compression ratio is maintained within the cylinder as the stroke length of the piston is varied.

2. The variable stroke assembly of claim 1 wherein the piston reciprocates within a piston cylinder of a positive displacement pump.

3. The variable stroke assembly of claim 1 wherein the actuation of the linkage assembly is automated.

4. The variable stroke assembly of claim 1 wherein the linkage assembly may be actuated remotely.

5. The variable stroke assembly of claim 1 wherein the slider is disposed within the variable stroke component.

6. The variable stroke assembly of claim 1 wherein the slider comprises a roller.

7. The variable stroke assembly of claim 1, wherein the variable stroke component has only three connections to other components of the linkage assembly.

8. The variable stroke assembly of claim 1, wherein the variable stroke component is not directly connected to a bracket in a pump or an engine.

9. The variable stroke assembly of claim 1, wherein the position of the slider is fixed relative to the piston.

10. The variable stroke assembly of claim 1 further comprising an actuator directly connected to the slider, and wherein the actuator positions the slider along the variable stroke component to set the stroke length of the piston.

11. The variable stroke assembly of claim 1, wherein the linkage assembly further comprises a positioning member connected to the variable stroke component via a pivotable, non-slidable connection.

12. The variable stroke assembly of claim 1, wherein the slider is moveable with respect to the variable stroke component, and wherein the slider movement along the variable stroke component is linear or concave with respect to the piston.

13. The variable stroke assembly of claim 1, wherein the slider is positionable such that the piston can be stopped when the variable stroke component is moving.

14. A variable stroke assembly comprising an actuatable linkage assembly operatively connected to a piston for varying the piston stroke length, wherein the linkage assembly comprises:

a variable stroke component;

a slider connecting the variable stroke component to the piston and configured to vary the stroke length of the piston;

a crankshaft throw having a length;

a connecting rod having a length and coupled to the crankshaft throw and the variable stroke component; and an actuator coupled to the variable stroke component.

15. The variable stroke assembly of claim 14 wherein the actuator is directly connected to the slider and positions the slider along the variable stroke component to set the stroke length of the piston.

16. The variable stroke assembly of claim 14 wherein the linkage assembly further comprises a positioning member connected to the variable stroke component via a pivotable, non-slidable connection.

17. The variable stroke assembly of claim 16 wherein the actuator moves the positioning member to position the variable stroke component.

18. The variable stroke assembly of claim 16 wherein the positioning member length equals the sum of the crankshaft throw length and the connecting rod length.

19. The variable stroke assembly of claim 14 wherein the variable stroke component comprises an arc.

20. The variable stroke assembly of claim 19 wherein the linkage assembly further comprises a cylinder rod connecting the piston to the variable stroke component, and wherein the radius of the arc equals the length of the cylinder rod.

21. The variable stroke assembly of claim 19 wherein the linkage assembly further comprises a positioning member connected to the variable stroke component via a pivotable, non-slidable connection, wherein the radius of the arc equals the length of the positioning rod.

22. The variable stroke assembly of claim 19, wherein the are is concave with respect to the piston.

23. The variable stroke assembly of claim 14 wherein the variable stroke component comprises a liner member.

24. The variable stroke assembly of claim 14 wherein the length of the connecting rod is at least twice the length of the crankshaft throw.

25. The variable stroke assembly of claim 14, wherein the slider is positionable such that the piston is stationary when the crankshaft throw is moving.

26. An engine or a pump comprising:

an engine or pump having a piston with a variable stroke length; and an actuatable linkage assembly for varying the stroke length of the piston and comprising a variable stroke component;

wherein the pump maintains a substantially constant unswept volume as the stroke length of the piston is varied, and wherein the variable stroke component has only three connections to other components of the linkage assembly.

27. A method for pumping a fluid comprising varying the stroke length of a piston in a positive displacement pump coupled to a motor while maintaining a substantially constant unswept volume or a substantially constant compression ratio within the pump, wherein the stroke length of the piston is varied by moving a slider coupled to the piston, and wherein the slider is positionable such that the piston can be stopped without stopping the motor.

28. The method of claim 27 wherein the stroke length of the pump piston is varied by an actuatable system.

29. The method of claim 27 wherein the stroke length of the pump is varied remotely by an actuatable system.

30. The method of claim 27 wherein the stroke length of the pump piston is varied by actuating a linkage assembly component to move a slider that connects to the pump piston.

31. The method of claim 27 wherein the substantially constant unswept volume is measured at the maximum stroke length of the piston.

32. The method of claim 27 further comprising completing a pressure stroke of the piston at a fully extended position of the piston regardless of the piston stroke length.

33. A method for operating an engine or pump comprising varying the stroke length of a piston in the engine or pump while maintaining a substantially constant unswept volume or a substantially constant compression ratio, wherein the stroke length of the piston is varied by moving a slider coupled to the piston, and wherein the position of the slider is fixed relative to the piston.

34. The method of claim 33 wherein the stroke length of the engine or pump piston is varied by an actuatable system.

35. The method of claim 32 wherein the stroke length of the engine or pump piston is varied remotely by an actuatable system.

* * * * *